US005147755A

United States Patent [19]

Katoh et al.

[11] Patent Number: 5,147,755

[45] Date of Patent: Sep. 15, 1992

[54] SILVER HALIDE PHOTOGRAPHIC MATERIAL

[75] Inventors: Kazunobu Katoh; Hisashi Okada, both of Kanagawa, Japan

[73] Assignee: Fuji Photo Film Co., Ltd., Kanagawa, Japan

[21] Appl. No.: 745,956

[22] Filed: Aug. 9, 1991

Related U.S. Application Data

[63] Continuation of Ser. No. 658,431, Feb. 20, 1991, abandoned, which is a continuation of Ser. No. 417,536, Oct. 5, 1989, abandoned.

[30] Foreign Application Priority Data

Oct. 5, 1988 [JP] Japan ..... 63-251213

[51] Int. Cl.[5] ..... G03C 1/06

[52] U.S. Cl. ..... 430/264; 430/267; 430/598; 430/949

[58] Field of Search ..... 430/264, 267, 949, 598

[56] References Cited

U.S. PATENT DOCUMENTS 4,816,373 3/1989 Ohashi ..... 430/264

4,851,321 6/1989 Takagi et al. ..... 430/264

*Primary Examiner*—Charles L. Bowers, Jr.

*Assistant Examiner*—Thorl Chea

*Attorney, Agent, or Firm*—Sughrue, Mion, Zinn, Macpeak & Seas

[57] ABSTRACT

An ultra-high contrast negative type silver halide photographic material is disclosed, wherein at least one hydrazine derivative of formula (I) and at least one compound of formula (IV) are contained in a silver halide emulsion layer or another hydrophilic collide layer of the photographic material:

(I)

wherein $A_1$ and $A_2$ both represent hydrogen atoms, or one represents a hydrogen atom and the other represents a sulfinic acid residual group or an acyl group, R represents an aliphatic group, an aromatic group or a heterocyclic group, and X represents a group as indicated by formulae (II) and (III)

(II)

wherein $X_1$ and $X_2$ each represent a hydrogen atom, an alkyl group, an alkenyl group, an aryl group, and $X_1$ and $X_2$ may be joined together to form a ring;

$$-O-X_3 \quad \text{(III)}$$

wherein $X_3$ represents a hydrogen atom, an alkyl group, an alkenyl group, an aryl group or a heterocyclic group; and $$Y_0\text{-}[(A_0)_n\text{-}B]_m \quad \text{(IV)}$$

wherein $Y_0$ represents a group which promotes adsorption on silver halide, $A_0$ represents a divalent linking group, B represents an amino group, an ammonium group, or a nitrogen containing heterocyclic group, m represents 1, 2 or 3, and n represents 0, or 1.

17 Claims, No Drawings

SILVER HALIDE PHOTOGRAPHIC MATERIAL

This is a continuation of application Ser. No. 07/658,431 filed Feb. 20, 1991, which in turn is a continuation of application Ser. No. 07/417,536 filed Oct. 5, 1989, both now abandoned.

FIELD OF THE INVENTION

This invention concerns silver halide photographic materials which provide very high contrast negative images, high speed negative images and good dot image quality or silver halide photographic materials which form direct positive photographic images and, more precisely, the invention concerns photographic photosensitive materials which contain novel compounds as silver halide nucleating agents.

BACKGROUND OF THE INVENTION

The addition of hydrazine compounds to silver halide photographic emulsions or development baths has been indicated, for example, in U.S. Pat. No. 3,730,727 (development baths in which ascorbic acid and hydrazine are used conjointly); U.S. Pat. No. 3,227,552 (where hydrazine is used as an auxiliary developing agent for obtaining direct positive color images); U.S. Pat. No. 3,386,831 (where the $\beta$-monophenylhydrazides of aliphatic carboxylic acids are included as stabilizers for silver halide sensitive materials); and in U.S. Pat. No. 2,1419,975 and "The Theory of the Photographic Process", by Mees, third edition, page 281. These cases, particularly U.S. Pat. No. 2,419,975, indicate that high contrast negative images are obtained by the addition of hydrazine compounds.

U.S. Pat. No. 2,419,975 discloses that very high contrast photographic characteristics with gamma ($\gamma$) values in excess of 10 can be obtained by adding hydrazine compounds to silver chlorobromide emulsions and developing the materials in development baths at a high pH, such as 12.8. But strongly alkaline development baths of a pH approaching 13 are very susceptible to aerial oxidation, are unstable, and are unable to withstand long term storage or use.

Photographic materials with ultra-high contrast, such that the value of gamma exceeds 10, are particularly useful for the photographic reproduction of continuous tone negative or positive dot images as used in the manufacture of printing plates and for the reproduction of line drawings. In the past, a gamma of more than 10 was achieved using methods of developing silver chlorobromide emulsions in which the silver chloride content exceeded 50 mol %, preferably 75 mol %, in hydroquinone development baths having an effective sulfite ion concentration of less than 0.1 mol/liter. With these methods, however, the sulfite ion concentration in the development bath is low resulting in development baths that are very unstable, and consequently unable to withstand storage for more than 3 days.

In addition, because these methods require the use of a silver chlorobromide emulsion, which has a comparatively high silver chloride content, it is impossible to realize high speeds.

For these reasons, there is a great need for ultra-high contrast photographic materials using high speed emulsions that can reproduce dot images and line drawings and can be developed in stable development baths.

The inventors disclosed silver halide photographic emulsions that provide very high contrast negative photographic characteristics using stable development baths in, for example, U.S. Pat. Nos. 4,224,401, 4,168,977, 4,243,739, 4,272,614 and 4,323,643, but the acylhydrazine compounds used therein are known to have some disadvantages. These conventional hydrazines produce nitrogen gas during development processing. This gas accumulates in the film and forms bubbles that adversely effect the photographic image. These hydrazine compounds also wash-out into the development processing baths where they adversely affect other photographic materials.

Furthermore, these conventional hydrazines must be used in large quantities in order to realize increased speed and contrast. In cases where an especially high speed is required necessitating conjoint use of other speed increasing techniques (for example, by increased chemical sensitization, increased grain size, or the addition of compounds that enhance sensitization such as those disclosed in U.S. Pat. Nos. 4,272,606 and 4,241,164) then, in general, an increase in speed with the passage of time on storage and increased fogging are liable to occur.

Hence, compounds, a small amount of which will give rise to the following, are desirable: less bubble formation and wash-out into the development bath; high stability with the passage of time; and very high contrast.

The acylhydrazine derivatives disclosed in EP 217,310, JP-A-62-178246 and JP-A-62-180361 were developed with a view to overcoming the problems indicated above, but these compounds do not have sufficient activity as nucleating agents to enable the pH of the processing baths to be reduced to raise the stability of development processing baths (which is to say, to prevent the deterioration of the developing agent) or to enable the development processing time to be shortened. (The term "JP-A" as used herein signifies an "unexamined published Japanese patent application".)

Furthermore, it has been disclosed in U.S. Pat. Nos. 4,385,108, 4,269,929 and 4,243,739 that very high contrast negative gradation photographic properties can be realized using hydrazines which have substituent groups which are readily adsorbed on silver halide grains, but those of the hydrazine compounds which have the adsorbing groups cited in the aforementioned publications present a problem in that they lead to desensitization with the passage of time on storage.

SUMMARY OF THE INVENTION

An object of the present invention is to provide silver halide photographic materials with which very high contrast negative gradation type photographic characteristics with a gamma in excess of 10 can be obtained using stable development baths.

Another object of the invention is to provide negative type silver halide photographic materials which contain highly active acylhydrazines that have no adverse effect on photographic performance and can provide very high contrast negative gradation photographic characteristics when added in small quantities even in development baths of low pH.

Yet another object of the invention is to provide silver halide photographic materials containing acylhydrazines that have good ageing stability, can be prepared easily, and have excellent storage properties.

These objects and others have been realized by means of ultra-high contrast negative type silver halide photographic materials comprising a support having thereon at least one silver halide emulsion layer and containing at least one hydrazine derivative represented by formula (I) and at least one compound represented by formula (IV) in said emulsion layer or another hydrophilic colloid layer provided on said support:

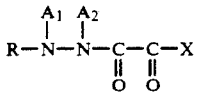

(I)

wherein $A_1$ and $A_2$ both represent hydrogen atoms, or one represents a hydrogen atom and the other represents a sulfinic acid residual group or an acyl group, R represents an aliphatic group, an aromatic group or a heterocyclic group, and X represents a group as nndicated by formulae (II) and (III) below,

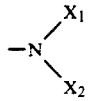

(II)

wherein $X_1$ and $X_2$ each represent a hydrogen atom, an alkyl group, an alkenyl group, an aryl group, an amino group or a heterocyclic group, and $X_1$ and $X_2$ may be joined together to form a ring, $$-O-X_3 \quad \text{(III)}$$

wherein $X_3$ represents a hydrogen atom, an alkyl group, an alkenyl group, an aryl group or a heterocyclic group;

$$Y_0\text{-}[(A_0)_n\text{-}B]_m \quad \text{(IV)}$$

$Y_0$ represents a group which promotes adsorption on silver halide, $A_0$ represents a divalent linking group, B represents an amino group, an ammonium group or a nitrogen containing heterocyclic group, m represents 1, 2 or 3, and n represents 0 or 1.

DETAILED DESCRIPTION OF THE INVENTION

Preferably $A_1$ and $A_2$ in formula (I) represent hydrogen atoms; alkylsulfonyl or arylsulfonyl groups having no more than 20 carbon atoms and more preferably no more than 12 carbon atoms (preferably phenylsulfonyl groups or substituted phenylsulfonyl groups of which the sum of the Hammett substituent constants is at least —0.5); or acyl groups having no more than 20 carbon atoms and more preferably no more than 12 carbon atoms (preferably benzoyl groups, substituted benzoyl groups of which the sum of the Hammett substituent constants is at least −0.5, or straight-chain., branched or cyclic, unsubstituted or substituted acyl groups (in which the substituent groups are, for example, halogen atoms, ether groups, sulfonamide groups, carbonamido groups, hydroxyl groups, carboxyl groups, sulfonic acid groups or acyl groups)). Examples of the sulfinic acid residual groups represented by $A_1$ and $A_2$ are disclosed in U.S. Pat. No. 4,478,928.

It is most desirable that both $A_1$ and $A_2$ represent hydrogen atoms.

The aliphatic groups represented by R in formula (I) preferably have no more than 20 carbon atoms and include straight chain, branched or cyclic alkyl, alkenyl or alkynyl groups.

The aromatic groups represented by R include monocyclic or dicyclic aryl groups, such as phenyl groups and naphthyl groups.

The heterocyclic groups represented by R include 3- to 10-membered saturated or unsaturated heterocyclic groups which contain at least one nitrogen, oxygen or sulfur atom. These heterocyclic groups may be monocyclic or they may take the form of condensed rings with other aromatic or heterocyclic rings. The preferred heterocyclic groups are 5- or 6-membered aromatic heterocyclic groups, such as pyridyl groups, imidazolyl groups, quinolinyl groups, benzimidazolyl groups, pyrimidyl groups, pyrazolyl groups, isoquinolinyl groups, thiazolyl groups and benzthiazolyl groups, for example.

R may be substituted with substituent groups and these substituent groups may be further substituted with substituent groups.

The following are examples of substituent groups: alkyl groups, aralkyl groups, alkoxy groups, aryl groups, substituted amino groups, acylamino groups, sulfonylamino groups, ureido groups, urethane groups, aryloxy groups, sulfamoyl groups, carbamoyl groups, alkylthio groups, arylthio groups, sulfonyl groups, sulfinyl groups, hydroxyl groups, halogen atoms, cyano groups, sulfo groups, acyl groups, alkoxycarbonyl groups, aryloxycarbonyl groups, acyloxy groups and carboxyl groups.

Where possible, these groups may be joined together to form rings.

R is preferably an aromatic groups, and most desirably an aryl group.

In formula (II) representing a group for X in formula (I), $X_1$ and $X_2$, which may be the same or different, each represents a hydrogen atom, a straight chain, branched or cyclic alkyl group (for example, methyl, ethyl, n-propyl, n-propyl, allyl, benzyl, isopropyl and cyclohexyl), an alkenyl group (for example, propenyl), an aryl group (for example, phenyl), an amino group (for example, amino and methylamino) or a heterocyclic group (for example, pyridyl).

$X_1$ and $X_2$ may bond to each other to form a ring which may be a saturated heterocyclic ring containing at least one hetero atom (for example, oxygen, sulfur and nitrogen), such as a pyrrolidyl group, a piperidyl group and a morprolino group.

$X_1$ and $X_2$ may be substituted with substituent groups which may be the same as those for R described above.

Further, in formula (III) representing the other group for X, $X_3$ represents a hydrogen atom, a straight chain, branched or cyclic alkyl group (for example, methyl, ethyl, n-propyl, n-octyl, allyl, benzyl, isopropyl and cyclohexyl), an aryl group (for example, phenyl and naphthyl), or a heterocyclic group (for example, pyridyl), which may be substituted with substituent groups such as those for R described above.

R or X may also have a group which promotes adsorption on silver halide.

Examples of substituent groups which can be adsorbed on silver halides-include nitrogen-containing heterocyclic groups; groups which have a thioamido linkage; groups which have a mercapto group; and groups which have a disulfide linkage. Specific examples of such adsorbing groups have been disclosed in U.S. Pat. No. 4,686,167 and Japanese Patent Application No. 62-247478.

The groups which promote adsorption on silver halide are preferably groups which have a mercapto group; a disulfide bond; or 5- or 6-membered nitrogen containing-heterocyclic groups.

Adsorption promoting groups having a mercapto group include aliphatic mercapto groups, aromatic mercapto groups and heterocyclic mercapto groups (for example, 5-mercaptotetrazole, 3-mercapto-1,2,4-triazole, 2-mercapto-1,3,4-thiadiazole, 2-mercaptobenzimidazole, 2-mercaptobenzothiazole, 2-mercapto-1,3,4-oxadiazole, 4-mercapto-1,3,3a,7-tetrazaindene and 2-mercaptopyrimidine). Compounds where there is a nitrogen atom adjacent to the carbon atom to which the —SH group is bonded, are tautomeric forms of the cyclic thioamido groups.

The 5- or 6-membered nitrogen-containing heterocyclic groups are combinations of nitrogen, oxygen, sulfur and carbon atoms. Preferred groups of this type include benzotriazole, triazole, tetrazole, imidazole, benzimidazole, imidazole, benzthiazole, thiazole, benzoxazole, oxazole, thiadiazole, oxadiazole and triazole based groups.

The substituent groups in this case are the same as those described as substituent groups for R.

Preferred adsorption promoting groups are heterocyclic mercapto groups (for example, 2-mercaptothiadiazolyl, 3-mercapto-1,2,4-triazolyl, 5-mercaptotetrazolyl, 2-mercapto-1,3,4-oxadiazolyl and 2-mercaptobenzoxazolyl); or nitrogen-containing heterocyclic groups (for example, benzotriazolyl, benzimidazolyl and imidazolyl). Most desirable are the heterocyclic mercapto groups.

The following are specific examples of compounds represented by the general formula (I), but the invention is not limited by these examples.

I-1

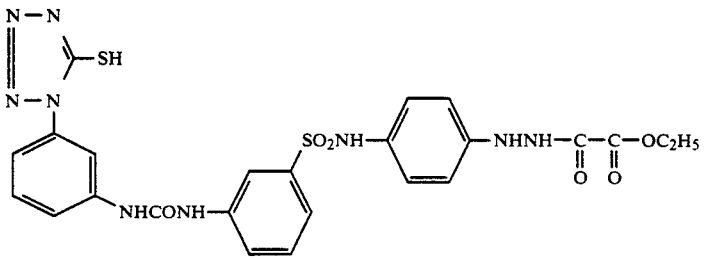

I-2

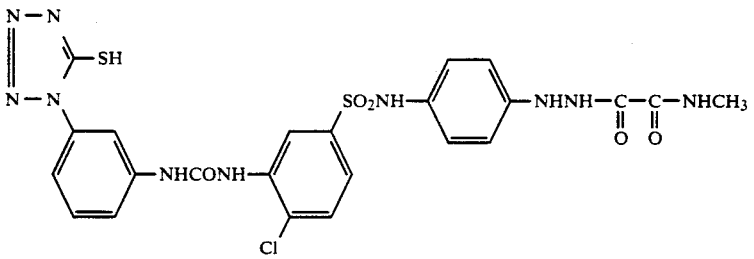

I-3

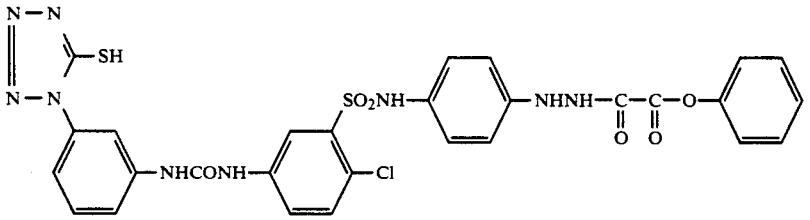

I-4

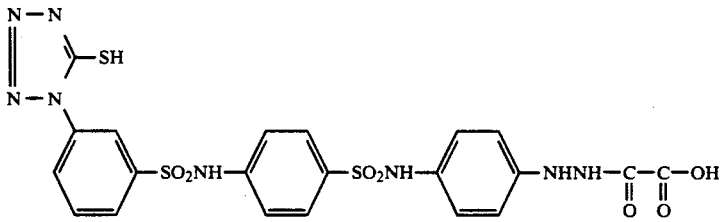

I-5

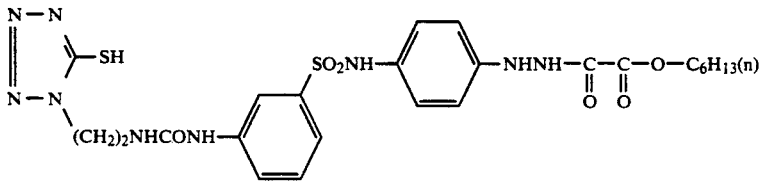

-continued
I-6
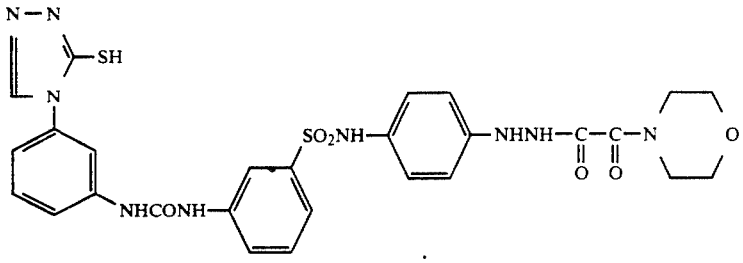
I-7
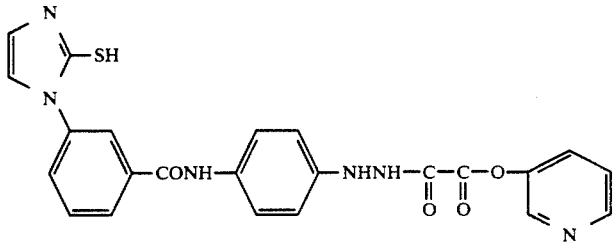
I-8
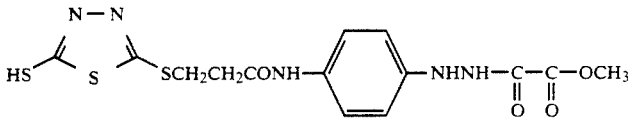
I-9
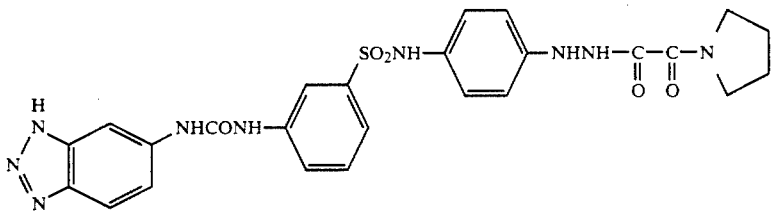
I-10
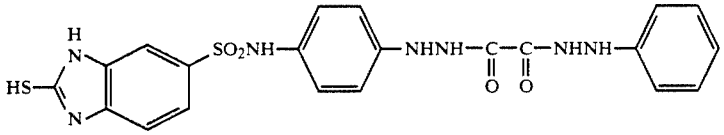
I-11
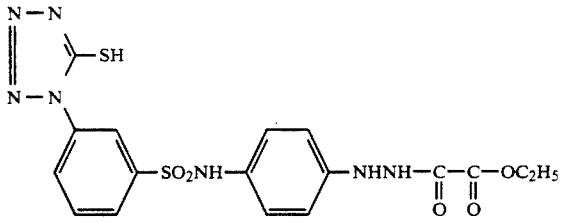
I-12
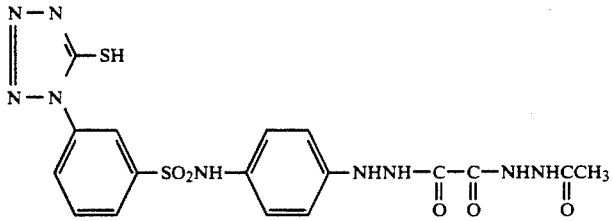
I-13
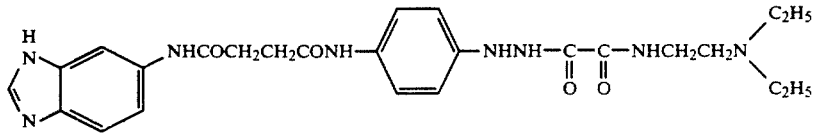

-continued
I-14
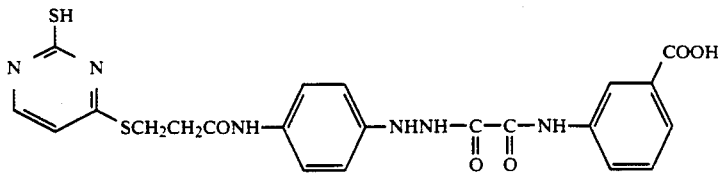
I-15
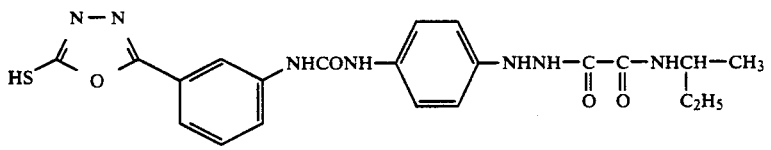
I-16
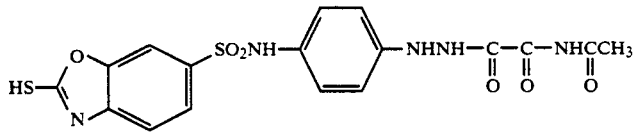
I-17
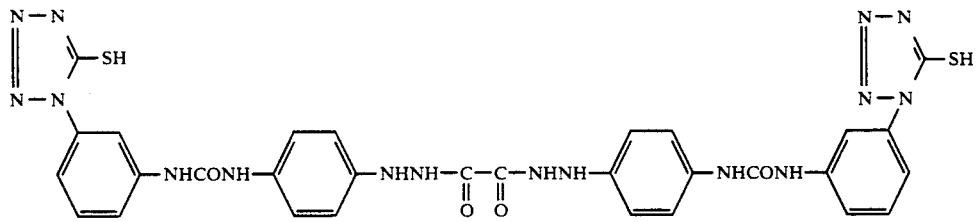
I-18
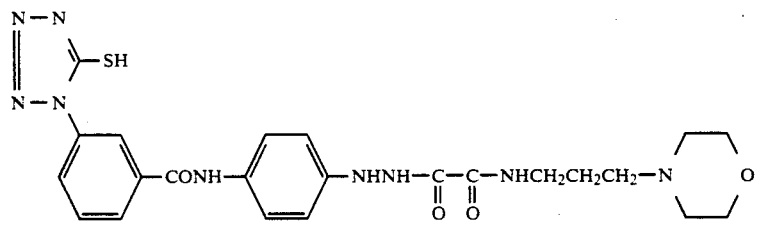
I-19
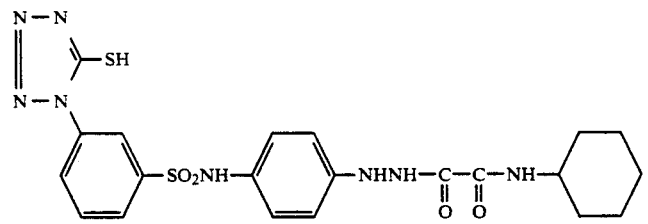
I-20
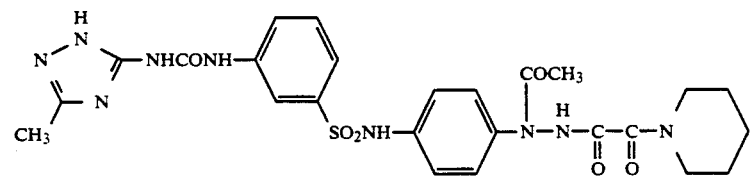
I-21
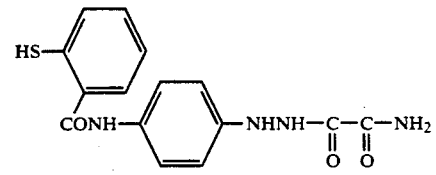

-continued
I-22
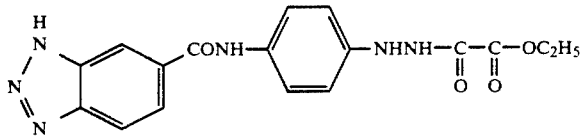
I-23
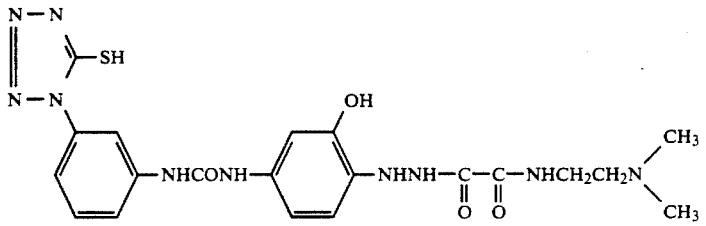
I-24
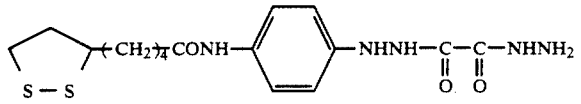
I-25
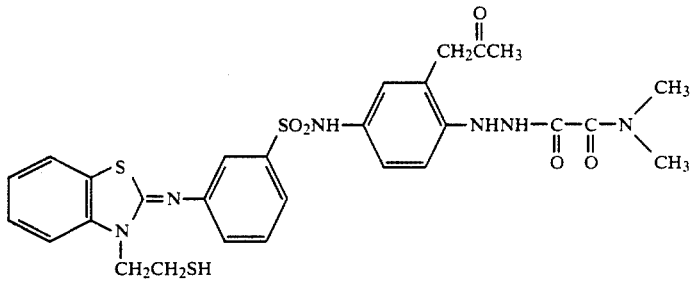
I-26
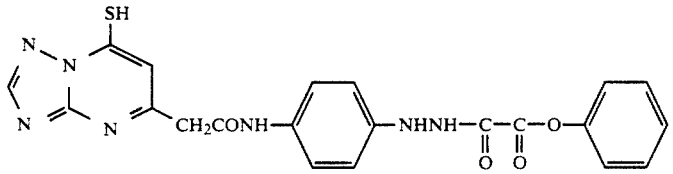
I-27
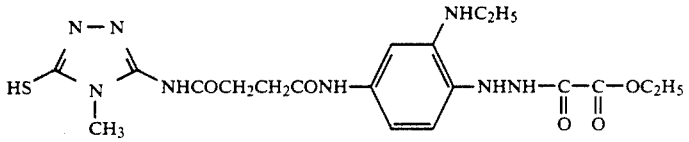
I-28
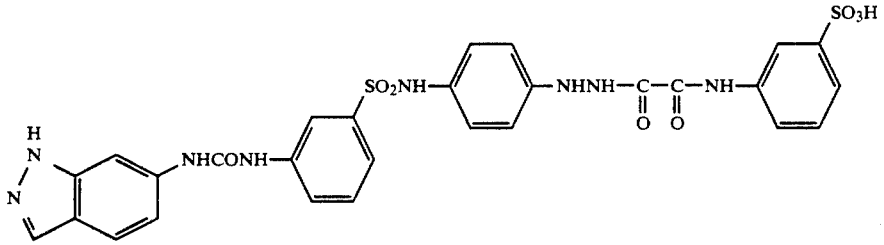
I-29
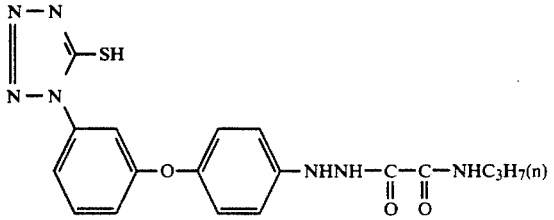

-continued
I-30
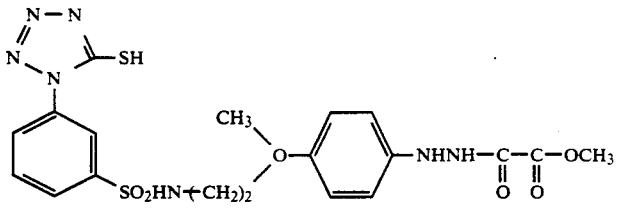
I-31
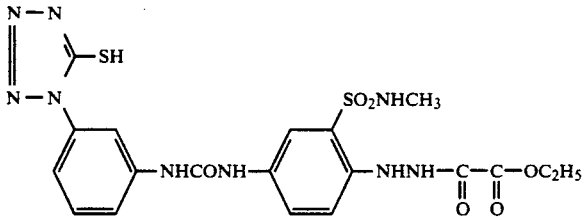
I-32
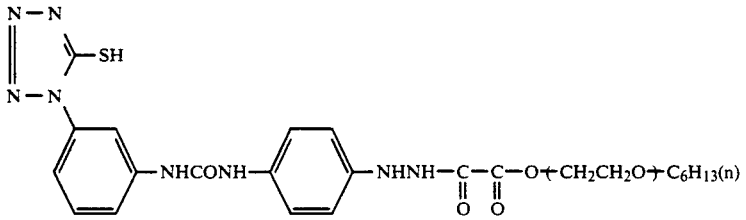
I-33
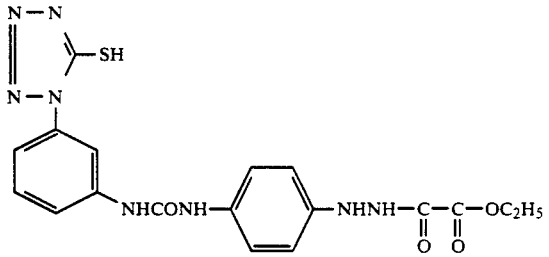
I-34
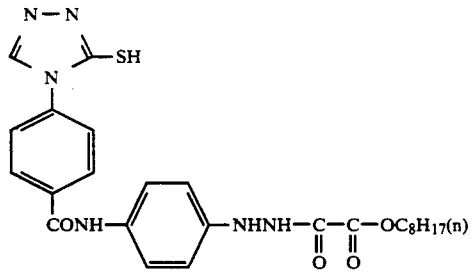
I-35
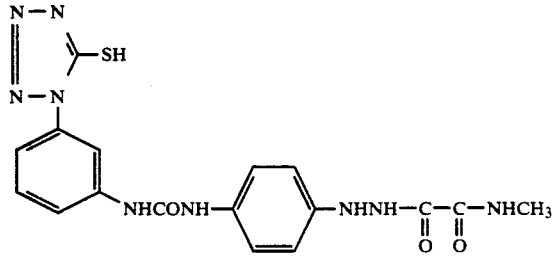

-continued
I-36
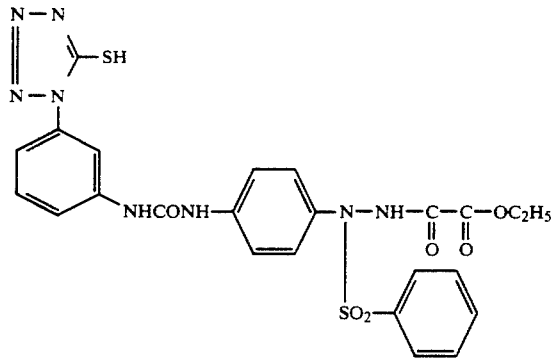
I-37
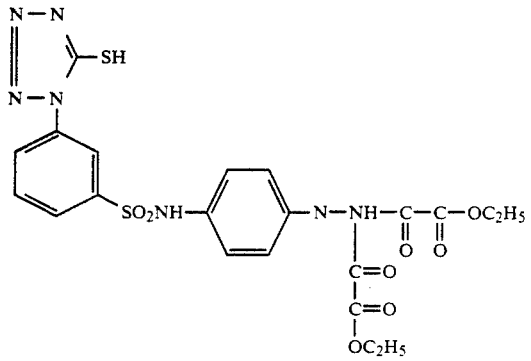
I-38
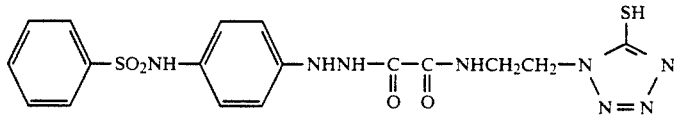
I-39
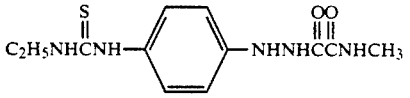
I-40
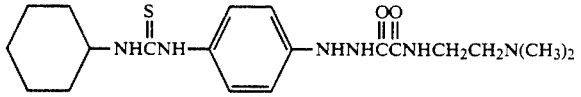
I-41
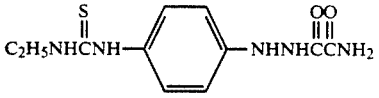
I-42
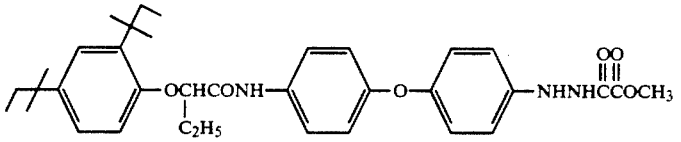
I-43
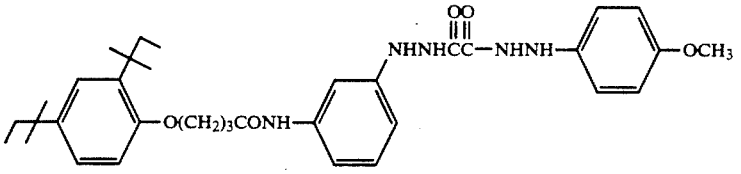
The compounds of this invention can be synthesized using various methods. Methods of synthesis have been specifically disclosed in Japanese Patent Application No. 62-247478 and U.S. Pat. No. 4,686,167.

The groups which promote adsorption on silver halide represented by $Y_0$ in formula (IV) include nitrogen-containing heterocyclic groups, groups which have a thioamide linkage, groups which have a mercapto group, and groups which have a disulfide linkage.

When $Y_0$ represents a nitrogen-containing heterocyclic group, the compounds of formula (IV) can be represented by formula (V).

(V)

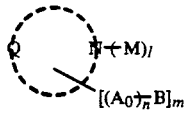

In this formula, l represents 0 or 1, $-[(A_0)_n-B]_m$ represents a group the same as that in the aforementioned general formula (IV), and Q represents a group of atoms which is required to form a 5- or 6-membered heterocyclic group comprised of at least one type of atom selected from carbon atoms, nitrogen atoms, oxygen atoms, sulfur atoms, selenium atoms and tellurium atoms. Furthermore, these heterocyclic rings may be condensed with carbocyclic aromatic rings or heterocyclic aromatic rings.

Examples of heterocyclic rings that can be formed by Q include substituted or unsubstituted indazoles, benzimidazoles, benzotriazoles, benzoxazoles, benzthiazoles, benzselenazoles, benztellurazoles, imidazoles, thiazoles, selenazoles, oxazoles, tellurazoles, triazoles, tetrazoles, oxazolines, imidazolines, thiazolines, selenazolines, indolenines, azaindenes, pyrazoles, indoles, triazines, pyrimidines, pyridines and quinolines. The preferred nitrogen-containing heterocyclic rings are benzotriazoles, triazoles, azaindenes and triazines, and of these the benzotriazoles are the most desirable.

Furthermore, these heterocyclic rings may be substituted, for example, with nitro groups; halogen atoms (for example, chlorine, bromine); mercapto groups; cyano groups; substituted or unsubstituted alkyl groups (for example, methyl, ethyl, propyl, t-butyl, cyanoethyl, methoxyethyl, methylthioethyl); aryl groups (for example, phenyl, 4-methanesulfonamidophenyl, 4-methylphenyl, 3,4-dichlorophenyl, naphthyl); aralkyl groups (for example, benzyl, 4-methylbenzyl, phenethyl); alkoxy groups (for example, methoxy, ethoxy); aryloxy groups (for example, phenoxy, 4-methoxyphenoxy); alkylthio groups (for example, methylthio, ethylthio, methoxyethylthio); arylthio groups (for example, phenylthio); sulfonyl groups (for example, methanesulfonyl, ethanesulfonyl, p-toluenesulfonyl); carbamoyl groups (for example, unsubstituted carbamoyl, methylcarbamoyl, phenylcarbamoyl); sulfamoyl groups (for example, unsubstituted sulfamoyl, methylsulfamoyl, phenylsulfamoyl); carbonamido groups (for example, acetamido, benzamido); sulfonamido groups (for example, methanesulfonamido, benzenesulfonamido, p-toluenesulfonamido); acyloxy groups (for example, acetyloxy, benzoyloxy); sulfonyloxy groups (for example, methanesulfonyloxy); ureido groups (for example, unsubstituted ureido, methylureido, ethylureido, phenylureido); thioureido groups (for example, unsubstituted thioureido, methylthioureido); acyl groups (for example, acetyl group, benzoyl group); heterocyclic groups (for example, 1-morpholino, 1-piperidino, 2-pyridyl, 4-pyridyl, 2-thienyl, 1-pyrazolyl, 1-imidazolyl, 2-tetrahydrofuryl, tetrahydrothienyl); oxycarbonyl groups (for example, methoxycarbonyl, phenoxycarbonyl); oxycarbonylamino groups (for example, methoxycarbonylamino, phenoxycarbonylamino, 2-ethylhexyloxycarbonylamino); amino groups (for example, unsubstituted amino, dimethylamino, methoxyethylamino, anilino); carboxylic acid groups or salts thereof; sulfonic acid groups or salts thereof; and hydroxyl groups.

The divalent linking group represented by $A_0$ is a divalent linking group comprising an atom or a group of atoms selected from carbon atoms, nitrogen atoms, oxygen atoms and sulfur atoms. It may consist, for example, of a straight chain or branched alkylene group preferably having up to 12 carbon atoms (for example, methylene, ethylene, propylene, butylene, hexylene, 1-methylethylene); a straight chain or branched alkenylene group preferably having up to 12 carbon atoms (for example, vinylene, 1-methylvinylene); a straight chain or branched aralkylene group preferably having up to 12 carbon atoms (for example, benzylidene); a straight chain or branched alkynylene group preferably having up to 12 carbon atoms (for example, $CH_2-C\equiv C-CH_2-$); an arylene group preferably having up to 12 carbon atoms (for example phenylene, naphthylene);

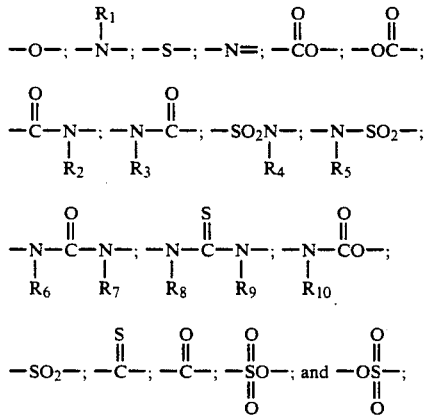

and groups that can be formed using any combination of these groups. $R_1$, $R_2$, $R_3$, $R_4$, $R_5$, $R_6$, $R_7$, $R_8$, $R_9$ and $R_{10}$ represent hydrogen atoms, or substituted or unsubstituted alkyl groups preferably having up to 12 carbon atoms (for example, methyl, ethyl, propyl, n-butyl); substituted or unsubstituted aryl groups preferably having up to 12 carbon atoms (for example, phenyl, 2-methylphenyl); substituted or unsubstituted alkenyl groups preferably having up to 12 carbon atoms (for example, propenyl, 1-methylvinyl); or substituted or unsubstituted aralkyl groups preferably having up to 12 carbon atoms (for example, benzyl, phenethyl).

The substituted or unsubstituted amino groups represented by B can be represented by formula (VI) indicated below.

(VI)

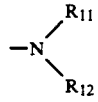

In this formula, $R_{11}$ and $R_{12}$ may be the same or different, each representing a hydrogen atom, a substituted or unsubstituted alky, alkenyl or aralkyl group having up to 30 carbon atoms or an aryl group having up to 20 carbon atoms. The alkyl and alkenyl groups may be straight chain groups (for example, methyl, ethyl, n-propyl, n-butyl, n-octyl, allyl, 3-butenyl, benzyl, 1-naphthylmethyl); branched (for example, iso-propyl, tert-octyl); or cyclic groups (for example, cyclohexyl). The aryl groups may be, for example, phenyl.

$R_{11}$ and $R_{12}$ may be joined to form a ring. Thus, they may be cyclized to form a saturated heterocyclic ring which contains one or more hetero atoms (for example, oxygen, sulfur or nitrogen atoms). Examples of such rings include the pyrrolidyl group, the piperidyl group and the morpholino group.

Examples of substituent groups for $R_{11}$ and $R_{12}$ include carboxyl groups; sulfo groups; cyano groups; halogen atoms (for example, fluorine, chlorine, bromine); hydroxyl groups; alkoxy- or aryloxycarbonyl groups which have not more than 20 carbon atoms (for example, methoxycarbonyl, ethoxycarbonyl, phenoxycarbonyl, benzyloxycarbonyl); alkoxy groups which have not more than 20 carbon atoms (for example, methoxy, ethoxy, benzyloxy, phenethyloxy); monocyclic aryloxy groups which have not more than 20 carbon atoms (for example, phenoxy, p-tolyloxy); acyloxy groups which have not more than 20 carbon atoms (for example, acetyloxy, propionyloxy); acyl groups which have not more than 20 carbon atoms (for example, acetyl, propionyl, benzoyl, mesyl); carbamoyl groups (for example, carbamoyl, N,N-dimethylcarbamoyl, morpholinocarbamoyl, piperidinocarbamoyl); sulfamoyl groups (for example, sulfamoyl, N,N-dimethylsulfamoyl, morpholinosulfamoyl, piperidinosulfamoyl); acylamino groups which have not more than 20 carbon atoms (for example, acetylamino, propionylamino, benzoylamino, mesylamino); sulfonamido groups (for example, ethylsulfonamido, p-toluenesulfonamido); carbonamido groups which have not more than 20 carbon atoms (for example, methylcarbonamido, phenylcarbonamido); ureido groups which have not mor than 20 carbon atoms (for example, methylureido, phenylureido); amino groups (the same as in formula (VI); and ammonium groups (the same as in formula (VII)).

The ammonium groups represented by B may have substituent groups, and those which ca be represented by formula (VII) are preferred.

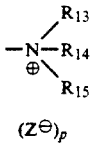

(VII)

$R_{13}$, $R_{14}$ and $R_{15}$ are the same groups as $R_{11}$ and $R^{12}$ in general formula (VI) described above, $Z^-$ represents an anion, for example, a halide ion (for example, $Cl^-$, $Br^-$, $I^-$); a sulfonate ion (for example, trifluoromethanesulfonate, p-toluenesulfonate, benzenesulfonate, p-chlorobenzenesulfonate); a sulfate ion (for example, ethylsulfate, methylsulfate); perchlorate ion; or tetrafluoroborate ion. Moreover, p represents 0, 1, 2 or 3. In cases where the compound forms an intramolecular salt, p has a value of 0.

The nitrogen-containing heterocyclic rings represented by B are 5- or 6-membered rings which contain at least one nitrogen atom. These rings may also have substituent groups and they may be condensed with other rings. Examples of nitrogen-containing heterocyclic groups include imidazolyl groups; pyridyl groups; thiazolyl groups and triazolyl groups.

M represents a hydrogen atom; an alkali metal atom (for example, sodium, potassium); an alkaline earth metal atom (for example, calcium, magnesium); an ammonium group (for example trimethylammonium, dimethylbenzylammonium); a phosphonium group (for example tetrabutylphosphonium, trimethylbenzylphosphonium); or a group which is such that M=H or an alkali metal atom under alkaline conditions (for example, acetyl, cyanoethyl, methanesulfonylethyl, amidino).

When $Y_0$ represents a group which has a thioamide linkage, the compound of formula (IV) can be represented by formula (VIII) or formula (IX) indicated below.

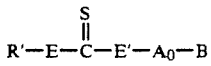

(VIII)

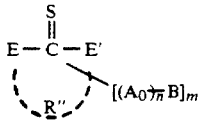

(IX)

In these formulae, $A_0$, B, m and n each has the same significance as defind above, and one of E or E' represents

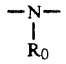

and the other represents —O—, —S— or —N—.

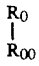

and $R_{00}$ each represents a hydrogen atom, an aliphatic group or an aromatic group. R' is a hydrogen atom, an aliphatic group or an aromatic group. The aliphatic group represented by $R_0$, $R_{00}$ and R' includes a straight chain, branched or cyclic alkyl, alkenyl or alkynyl group, and the aromatic group represented by $R_0$, $R_{00}$ and R' includes a monocyclic or dicyclic aryl group such as a a phenyl group. Furthermore, the above mentioned aliphatic groups and aromatic groups may have substituent groups such as alkyl groups, aralkyl groups, alkxy groups, aryl groups, substituted amino groups, acylamino groups, sulfonylamino groups, ureido groups, urethane groups, aryloxy groups, sulfamoyl groups, carbamoyl groups, alkythio groups, arythio groups, sulfonyl groups, sulfinyl groups, hydroxy groups, halogen atoms, cyano groups, sulfo groups, acyl groups, alkoxycarbonyl groups, aryloxycarbonyl groups, acyloxy groups and carboxy groups. These substituents may further be substituted. R'' is joined to E and E' and represents the group of atoms required to form a 5- or 6-membered ring, and the ring which is so formed may be condensed with an aromatic ring.

Groups derived from thiourea, thiourethane and dithiocarbamic acid esters, are examples of thioamide groups represented by

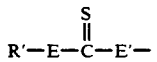

in formula (VIII). Examples of 5- and 6-membered rings which can be formed by R'' in formula (IX) include rings as regarded as acidic nyclei of merocyanine dyes, such as 4-thiazolin-2-thione; thiazolidin-2-thione; 4-oxazolin-2-thione; oxazolidin-2-thione; 2-pyrazolin-5-thione; 4-imidazolin-2-thione; 2-thiohydantoin; rhodanine; isorhodanine; 2-thio-2,4-oxazolidinedion; thiobarbituric acid; tetrazolin-5-thione; 1,2,4-triazoline-3-thione; 1,3,4-thiadiazolin-2-thione; 1,3,4-oxadiazoline-2-thione; benzimidazoline-2-thione; benzoxazolin-2-thione and benzothiazolin-2-thione; and benzselenazolin-2-thione. Of these, the tetrazolin-5-thione ring and the 1,3,4-thiadiazolin-2-thione ring are preferred, and the tetrazolin-5-thione ring is the most desirable. Furthermore, these rings may be further substituted, and the substituent groups described as substituent groups for the heterocyclic groups formed by Q in the aforementioned formula (V) can be present in this case.

When $Y_0$ represents a group which has a mercapto group the compounds of formula (IV) can be represented by formula (X) indicated below.

$$Z\text{-}[(A_0)_n\text{-}B]_m \qquad (X)$$

In this formula, $A_0$, B, m and n have the same significance as in the aforementioned formulae, and Z represents an aliphatic mercapto group, an aromatic mercapto group or a heterocyclic mercapto group (those in which there is a nitrogen atom adjacent to the carbon atom to which the —SH group is bonded have already been described as a tautomeric form of the cyclic thioamido groups). Examples of aliphatic mercapto groups include mercaptoalkyl groups preferably having up to 12 carbon atoms (for example, mercaptoethyl, mercaptopropyl); mercaptoalkenyl group preferably having up to 12 carbon atoms (for example, mercaptopropenyl); and mercaptoalkynyl groups preferably having up to 12 carbon atoms (for example, mercaptobutynyl). Examples of aromatic mercapto groups include mercaptophenyl and mercaptonaphthyl. Examples of heterocyclic mercapto groups include, in addition to those described as cyclic thioamido groups, 4-mercaptopyridyl, 5-mercaptoquinolinyl, 6-mercaptobenzothiazolyl and mercaptoazaindenyl, and of these, the mercaptoazaindenyl group is preferred. These groups may be formed by any combination of the above mentioned groups, and they may be further substituted. The substituent groups in this case may be the same as the substituent groups for the heterocyclic rings formed by Q in the aforementioned formula (V). The above mentioned mercapto groups may be a salt in the form -SM, where M has the same significance as in the aforementioned formula (V).

In cases where $Y_0$ represents a group that has a disulfide linkage, the compounds of formula (IV) can be represented by formula (XI) indicated below.

$$D\text{-}S\text{-}S\text{-}A_0\text{-}B \qquad (XI)$$

In this formula, $A_0$ and B have the same significance as in the aforementioned formulae. D represents a substituted or unsubstituted alkyl, alkenyl, aralkyl or aryl group preferably having up to 20 carbon atoms. These groups may be straight chain groups (for example methyl, ethyl, n-octyl, allyl, 3-butenyl, benzyl, 1-naphthylmethyl); branched groups (for example, iso-propyl); or cyclic groups (for example, cyclohexyl). The substituent groups for D are the same as those described in connection with $R_{11}$ and $R_{12}$ in the aforementioned formula (VI), but they are preferably amino groups or ammonium groups. D and $A_0$ may also be joined to form a ring.

Illustrative compounds represented by formula (IV) are indicated below, but the invention is not limited by these examples.

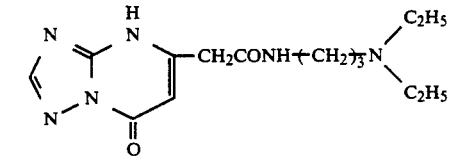

IV-1

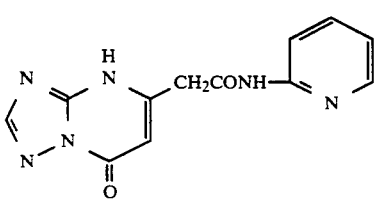

IV-2

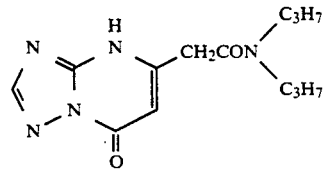

IV-3

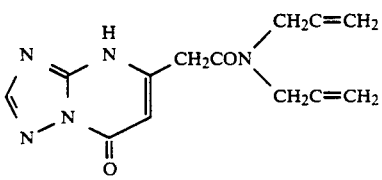

IV-4

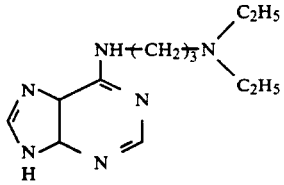

IV-5

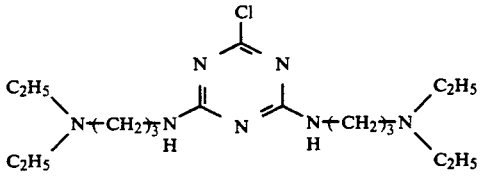

IV-6

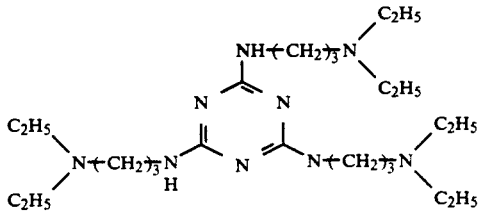

IV-7

-continued
IV-8
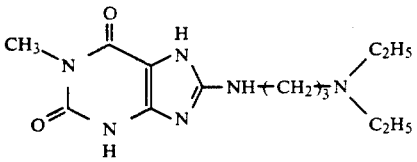
IV-9
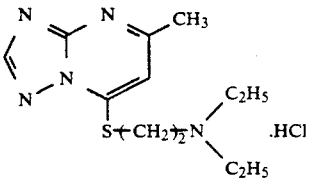
IV-10
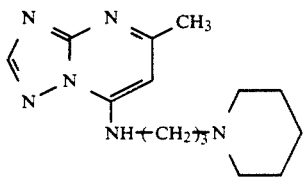
IV-11
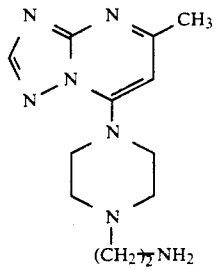
IV-12
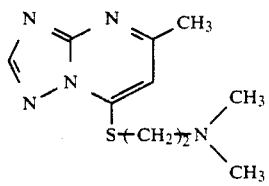
IV-13
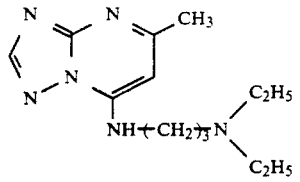
IV-14
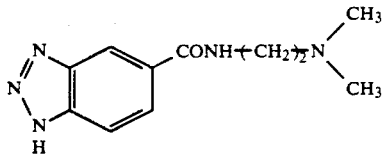
IV-15
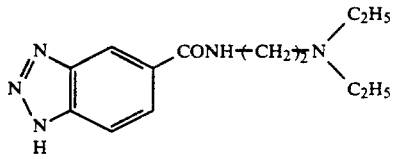
-continued
IV-16
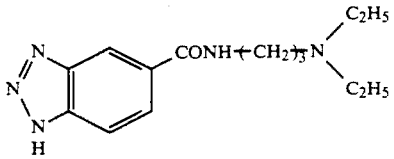
IV-17
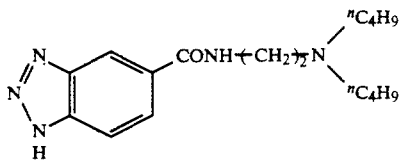
IV-18
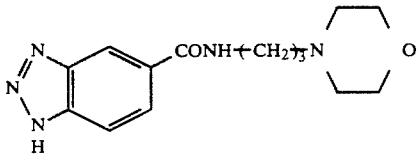
IV-19
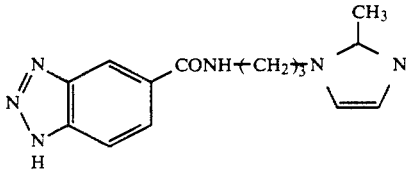
IV-20
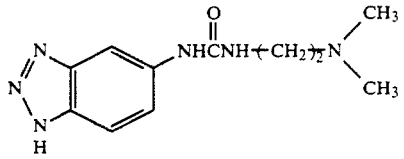
IV-21
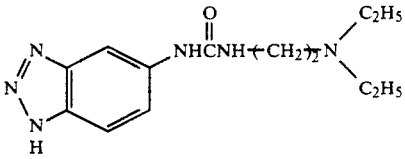
IV-22
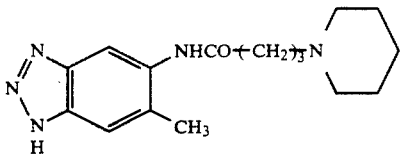
IV-23
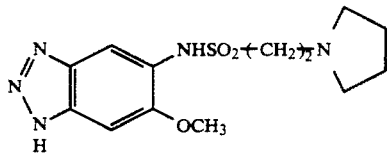
IV-24
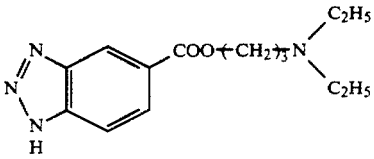

-continued
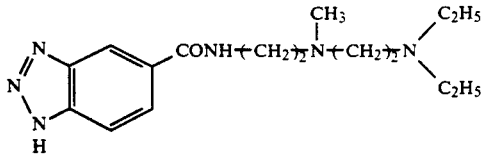
IV-25
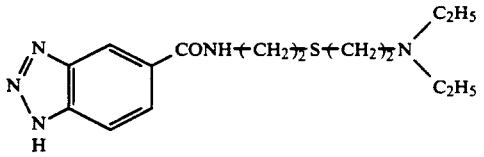
IV-26
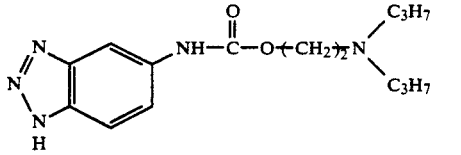
IV-27
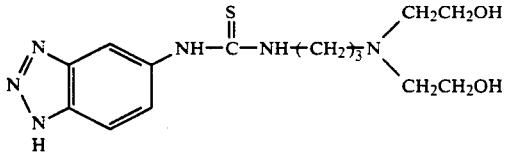
IV-28
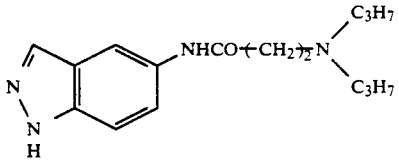
IV-29
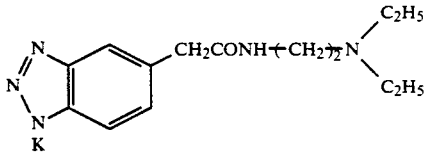
IV-30
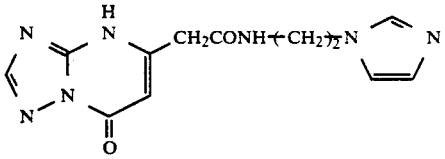
IV-31
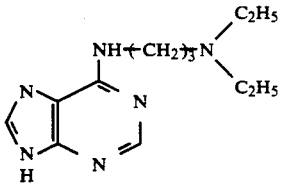
IV-32
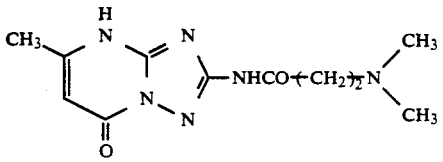
IV-33
-continued
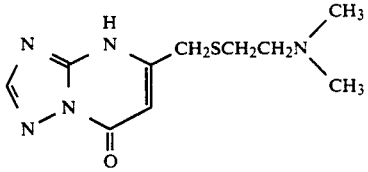
IV-34
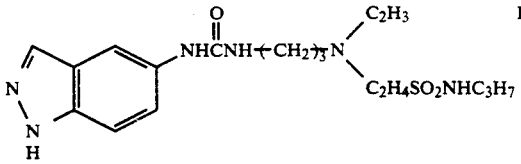
IV-35
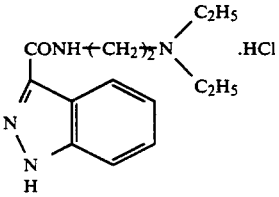
IV-36
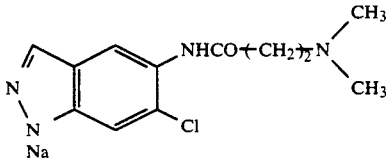
IV-37
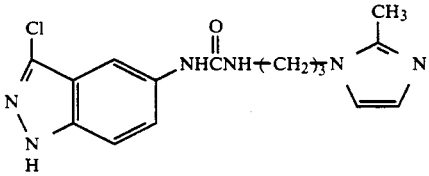
IV-38
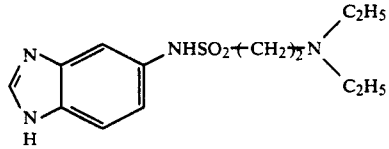
IV-39
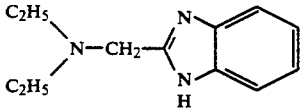
IV-40
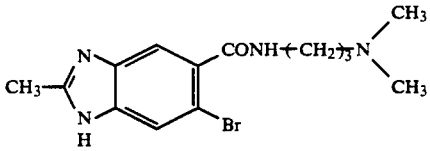
IV-41
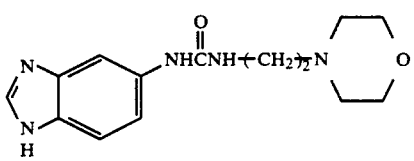
IV-42

-continued
IV-43
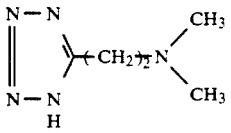
IV-44
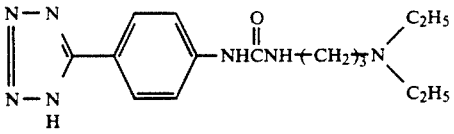
IV-45
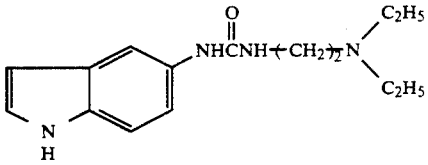
IV-46
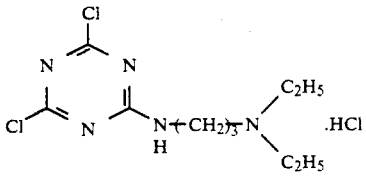
IV-47
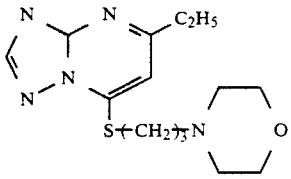
IV-48
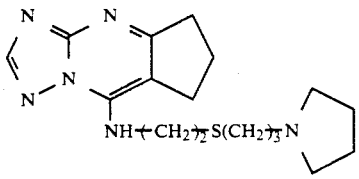
IV-49
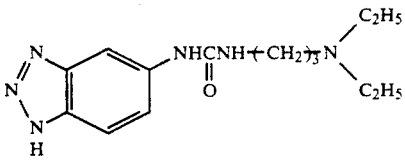
IV-50
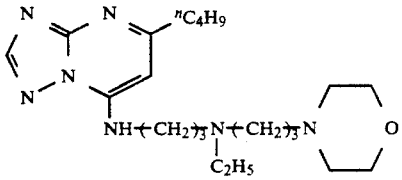
IV-51
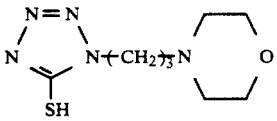
IV-52
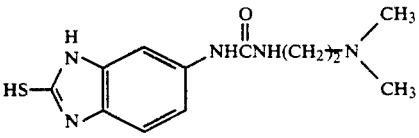
-continued
IV-53
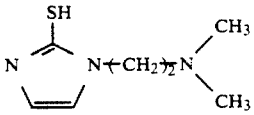
IV-54
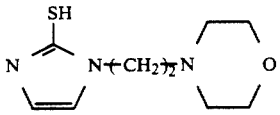
IV-55
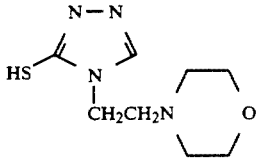
IV-56
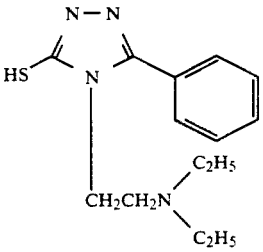
IV-57
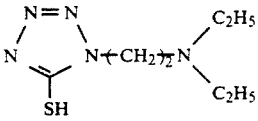
IV-58
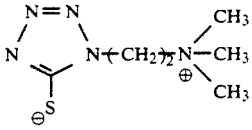
IV-59
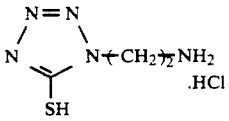
IV-60
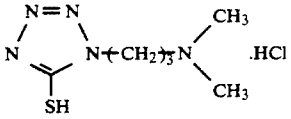
IV-61
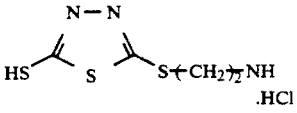
IV-62
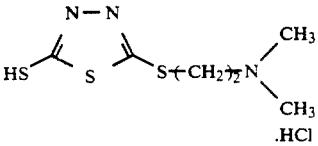

-continued
IV-63
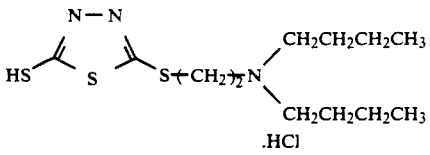
IV-64
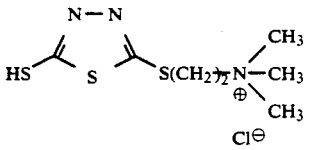
IV-65
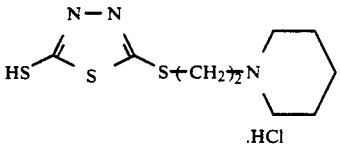
IV-66
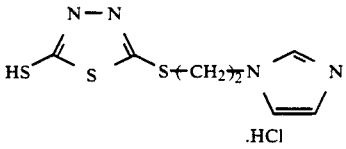
IV-67
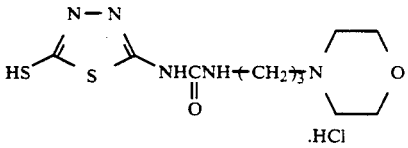
IV-68
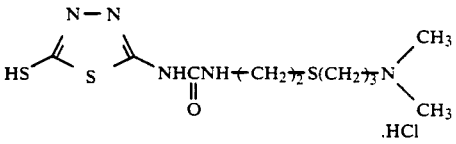
IV-69
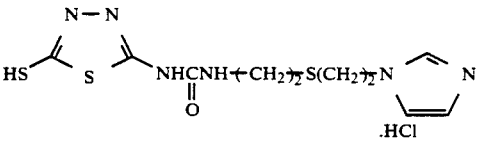
IV-70
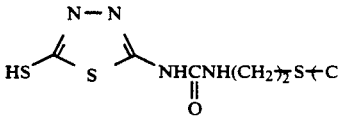
IV-71
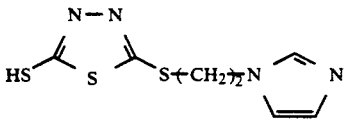
IV-72
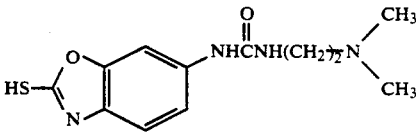
-continued
IV-73
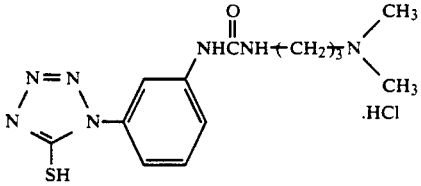
IV-74
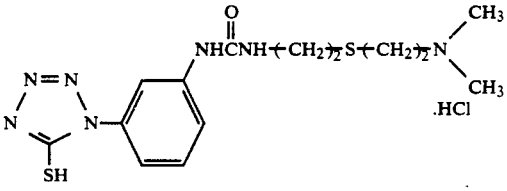
IV-75
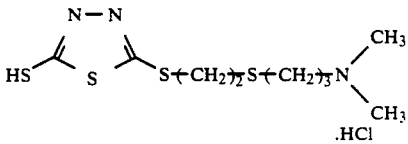
IV-76
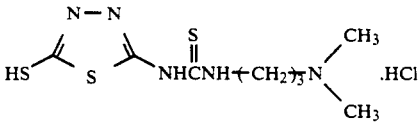
IV-77
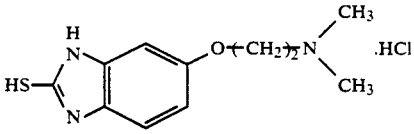
IV-78
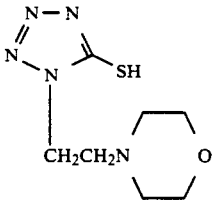
IV-79
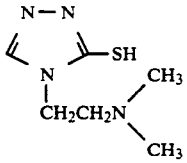
IV-80
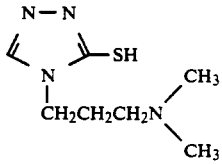
IV-81
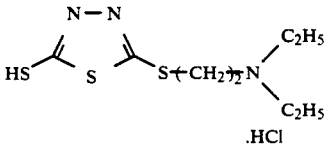

-continued
IV-82
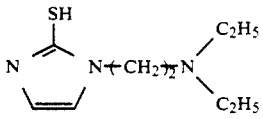
IV-83
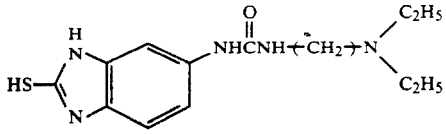
IV-84
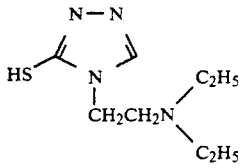
IV-85
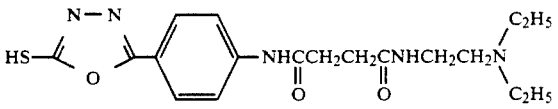
IV-86
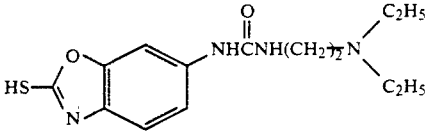
IV-87
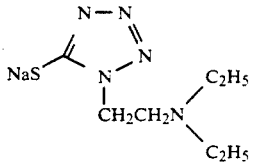
IV-88
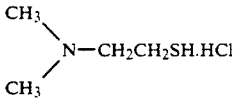
IV-89
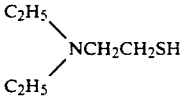
IV-90
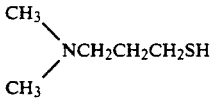
IV-91
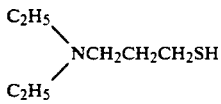
IV-92
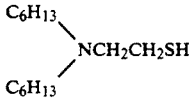
IV-93
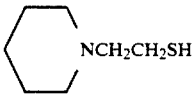
-continued
IV-94
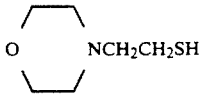
IV-95
$(HOCH_2CH_2)_2NCH_2CH_2SH$
IV-96
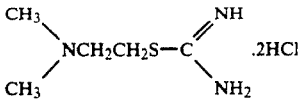
IV-97
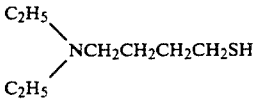
IV-98
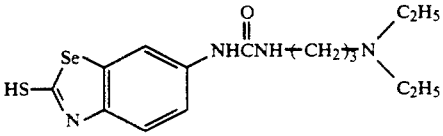
IV-99
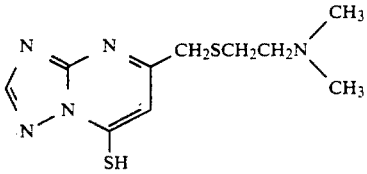
IV-100
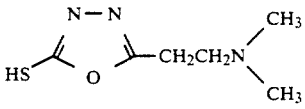
IV-101
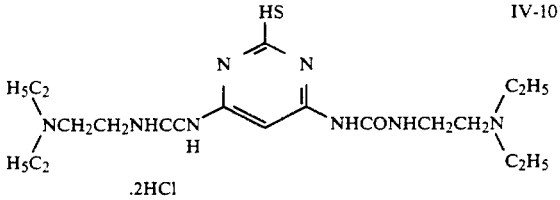
IV-102
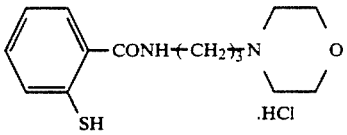
IV-103
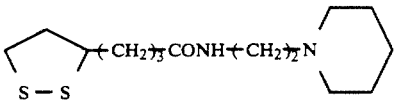
IV-104
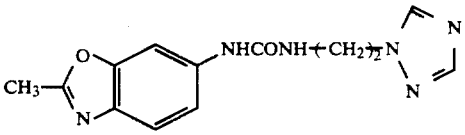
IV-105
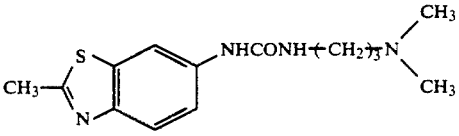

-continued

IV-106

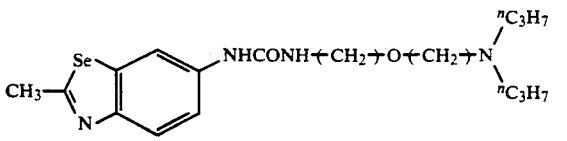

IV-107

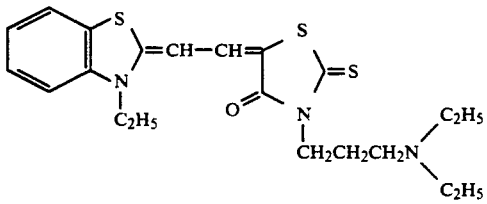

IV-108

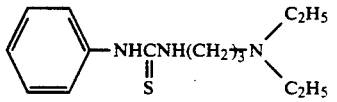

IV-109

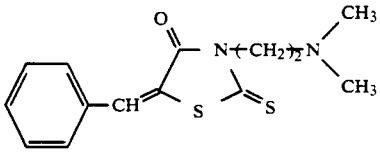

IV-110

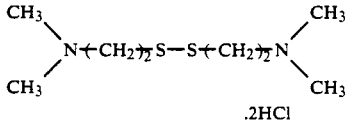

IV-111

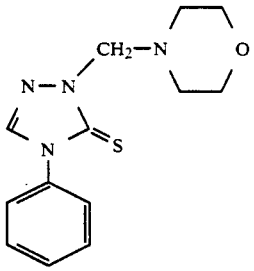

The nucleation agents represented by formula (IV) of the invention can be synthesized, for example, using the methods described in Berichte der "Deutschen Chemischen Gesellschaft" 28, 77 (1895); JP-A-50-37436; JP-A-51-3231; U.S. Pat. Nos. 3,295,976 and 3,376,310; "Berichte der Deutschen Chemischen Gesellschaft" 22, 568 (1889); "Berichte der Deutschen Chemischen Gesellschaft", 29, 2483 (1896); "J. Chem. Soc.", 1932, 1806; "J. Am. Chem. Soc.", 45, 1932, 1806; "J. Am. Chem. Soc.", 71, 4000 (1946); U.S. Patents 2,585,388 and 2,541,924; "Advances in Heterocyclic Chemistry", 9, 165, (1968); "Organic Synthesis" IV, 569 (1963); "J. Am Chem. Soc.", 45, 2390 (1923); "Chemische Berichte", 9, 465 (1876); JP-B-40-28496; JP-A-50-89034; U.S. Pat. Nos. 3,106,467, 3,420,670, 2,271,229, 3,137,578, 3,148,066, 3,511,663, 3,060,028, 3,271,154, 3,251,691, 3,598,599 and 3,148,066; JP-B-43-4135; U.S. Pat. Nos. 3,615,616, 3,420,664, 3,071,465, 2,444,605, 2,444,606, 2,444,607 and 2,935,404; JP-A-57-202531; JP-A-57-167023; JP-A-57-164735; JP-A-60-80839; JP-A-58-152235; JP-A-57-14836; JP-A-59-162546; JP-A-60-130731; JP-A-60-138548; JP-A-58-83852; JP-A-58-159529; JP-A-59-159162; JP-A-60-217358; JP-A-61-80238; JP-A-60-29390; JP-B-60-29391; JP-B-60-133061; and JP-B-61-1431. (The term "JP-B" as used herein signifies an "examined Japanese patent publication".)

When, in this invention, the compounds represented by formulae (I) and (IV) are included in photosensitive material, they are preferably included in a silver halide emulsion layer, but they may be included instead in a non-photosensitive hydrophilic colloid layer (for example in a protective layer, intermediate layer, filter layer or anti-halation layer). In practical terms, the compounds used may be added to the hydrophilic colloid layer in the form of an aqueous solution if they are soluble in water, or in the form of a solution in an organic solvent which is miscible with water, such as an alcohol, ester or ketone; if they are sparingly soluble in water. When added to a silver halide emulsion layer, they may be added at any time from the commencement of chemical ripening prior to coating. Their addition during the interval after the completion of chemical ripening and prior to coating is preferred. Their addition to a liquid that has been prepared for coating is especially desirable.

The amount of the compound of formula (I) of this invention included is preferably appropriately selected in accordance with the following; the grain size and halogen composition of the silver halide emulsion; the method and extent of chemical sensitization; the relationship between the layer containing the compound(s) and the silver halide emulsion layer; the type of antifoggants being used; The test methods used to make such a selection are well known in the industry.

Normally, the use of an amount of the compound of formula (I) from $10^{-6}$ to $1\times10^{-1}$ mol per mol of silver halide is preferred, and the use of an amount within the range from $1\times10^{-5}$ to $1\times10^{-2}$ mol per mol of silver halide is especially desirable. The compound(s) of formula (I) and the compound(s) of formula (IV) need not always be included in the same layer.

The amount of the compound(s) represented by formula (IV) included is preferably from $1.0\times10^{-3}$ g/m$^2$, to 0.5 g/m$^2$ and most desirably within the range from $5.0\times10^{-3}$ to 0.2 g/m$^2$.

The silver halide emulsions used in the invention may be composed of silver chloride, silver chlorobromide, silver iodobromide, silver iodochlorobromide or any equivalent silver halide compound or combination of compounds.

In the case of sensitive materials for reverse process purposes the use of a silver halide comprising at least 60 mol %, and preferably at least 75 mol %, of silver chloride is preferred. The use of silver chlorobromides or silver chloroiodobromides which contain not more than 5 mol % silver bromide is preferred for the purposes.

In the case of sensitive materials for screening process purposes, the use of silver halides comprising at least 70 mol %, and preferably at least 90 mol %, of silver bromide is preferred. The use of emulsions of which the silver iodide content is not more than 10 mol %, and preferably from 0.1 to 5 mol %, is also desirable.

The average grain size of the silver halide used in the invention is preferably fine (for example, less than 0.7 μ), and grain sizes of not more than 0.5 μ are especially desirable. No particular limitation is imposed upon the grain size distribution, but the use of a mono-dispersion is preferred. Here, the term "mono-dispersion" signifies an emulsion in which 95% of the grains in terms of weight or in terms of the number of grains are of a size within ±40% of the average grain size.

The silver halide grains in the photographic emulsion may have a regular crystalline form, such as a cubic or octahedral form; or they may have an irregular crystalline form, such as a spherical or plate-like form; or they may have a composite form comprised of these crystalline forms.

The silver halide grains may be such that the interior part and the surface layer consist of a uniform phase, or the interior part and the surface layer may consist of different phases. Use can also be made of two or more types of silver halide emulsion which have been formed separately.

Cadmium salts, sulfites, lead salts, thallium salts, rhodium salts or complex salts thereof, and iridium salts or complex salts thereof, for example, may be present during the formation of the silver halide grains or during the physical ripening process of a silver halide emulsion which is used in the invention.

Examples of rhodium salts which can be used for this purpose included rhodium monochloride, rhodium dichloride, rhodium trichloride, and ammonium hexachlororhodinate. The use of water soluble halogeno complex salts of trivalent rhodium (such as hexachlororhodium (III) acid or the salts (for example, the ammonium, sodium or potassium salts) thereof) are preferred.

The amount of these water soluble rhodium salts added is within the range of $1.0\times10^{-8}$ mol to $1.0\times10^{-3}$ mol per mol of silver halide. The amount used is preferably from $1.0\times10^{-7}$ mol to $5.0\times10^{-4}$ mol per mol of silver halide.

The silver halide emulsions used in the method of this invention may or may not be chemically sensitized. Chemical sensitization of the silver halide emulsions can be achieved using the known sulfur sensitization, reduction sensitization and noble metal sensitization methods, either independently of conjointly.

Gold compound, and principally gold complex salts are used typically for noble metal sensitization. Complex salts of platinum, palladium or iridium, for example, can be included instead of gold. Specific examples have been disclosed, for example, in U.S. Pat. No. 2,448,060 and British Patent 618,061.

Various sulfur compounds, such as thiosulfates, thiureas, thiazoles and rhodanines, for example, can be used as sulfur sensitizing agents as well as the sulfur compounds which are included in gelatin.

Stannous salts, amines, formamidinesulfinic acid and silane compounds can be used, for example, as reduction sensitizing agents.

Spectrally sensitizing dyes can be added to the silver halide emulsion layer used in the invention. In this connection, useful sensitizing dyes, combinations of dyes which exhibit super-sensitization and substances which exhibit super-sensitization have been disclosed in section IV-J on page 23 of "Research Disclosure" volume 176, item number 17643 (published December 1978).

Gelatin is useful as a binding agent or protective colloid in photographic emulsions, but other hydrophilic colloids can be used for this purpose. Thus, gelatin derivatives, graft polymers of gelatin with other polymers, proteins such as albumin and casein, cellulose derivatives such as hydroxyethylcellulose, carboxymethylcellulose and cellulose sulfate esters, sodium alginate, sugar derivatives such as starch derivatives, and a great many synthetic hydrophilic polymeric materials, such as poly(vinyl alcohol), partially acetalated poly(vinyl alcohol), poly(N-vinylpyrrolidone), poly(acrylic acid), poly(methacrylic acid), polyacrylamide, polyvinylimidazole and polyvinylpyrazole, either alone or in the form of co-polymers, can be used, for example, for this purpose.

Lime-treated gelatins, acid-treated gelatins gelatin hydrolyzates, and enzyme degradation products of gelatin can also be used as gelatin in the invention.

Various compounds can be included in the photosensitive materials of this invention with a view to preventing the occurrence of fogging during the manufacture, storage, or photographic processing of the sensitive material or with a view to stabilizing photographic performance. Thus many compounds which are known as anti-fogging agents or stabilizers, such as azoles (for example, benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles and nitrobenzotriazoles); mercaptopyrimidines; mercaptotriazines; thioketo compounds (such as oxazolinethione); azaindenes (for example, triazaindenes, tetraazaindenes (especially 4-hydroxy substituted (1,3,3a,7)tetraazaindenes) and penta-azaindenes); hydroquinone and derivatives thereof; disulfides (for example, thioctic acid); benzenethiosulfonic acid; benzenesulfinic acid; benzenesulfonic acid amide; etc.; can be added for this purpose. From among these compounds, the benzotriazoles (for example, 5-methylbenzotriazole) and the nitroindazoles (for example, 5-nitroindazole) are preferred. Furthermore, these compounds may be included in the processing bath.

The photosensitive materials of this invention may contain organic desensitizing agents.

The preferred organic desensitizing agents have at least one water solubilizing group and an alkali dissociable group.

These preferred organic desensitizing agents have been described in JP-A-63-64039. When organic desensitizing agents are used, the inclusion of from $1.0\times10^{-8}$ to $1.0\times10^{-4}$ mol/m$^2$, and preferably of from $1.0\times10^{-7}$ to $1.0\times10^{-5}$ mol/m$^2$ in the silver halide emulsion layer is appropriate.

The photosensitive materials of this invention may include other development accelerators.

Other development accelerators or accelerators for nucleation infectious development which are appropriate for use in the invention include the compounds disclosed, for example, in JP-A-53-77616, JP-A-54-37732, JP-A-53-137133, JP-A-60-140340, and JP-A-60-14959. Various compounds which contain nitrogen or sulfur atoms are also effective for this purpose.

Actual examples are indicated below.

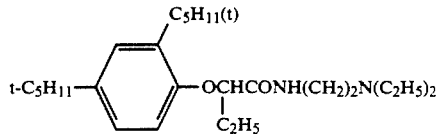

DA-(1)

-continued

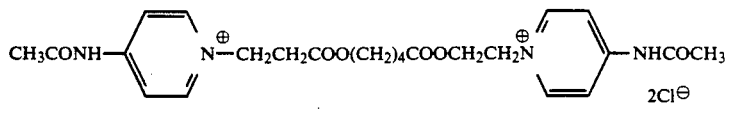

DA-(2)

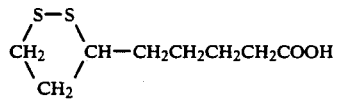

DA-(3)

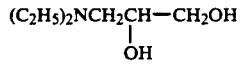

DA-(4)

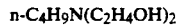

DA-(5)

A plurality of these additives can be used conjointly.

Water soluble dyes can be included in the emulsion layers or other hydrophilic colloid layers in this invention as filter dyes, for the prevention of irradiation or for a variety of other purposes. Dyes for reducing the photographic speed, especially ultraviolet absorbers which have a spectral absorption peak in the intrinsically sensitive region of silver halides, and dyes which essentially absorb light principally in the 310 to 600 nm region can be used as filter dyes for raising their safety in safe-lighting to permit handling the photosensitive materials in room light.

These dyes are preferably used by addition to the emulsion layer or by addition, together with a mordant, and fixation above the silver halide emulsion layer, that is to say in a non-photosensitive hydrophilic colloid layer which is further from the support than the silver halide emulsion layer.

The amount of dye added depends on the molar extinction coefficient of the dye being used, but it is normally within the range of from $10^{-3}$ g/m$^2$ to 1 g/m$^2$, and preferably within the range of from 10 mg/m$^2$ to 500 mg/m$^2$.

The above mentioned dyes can be added to the coating liquid in the form of a solution in a suitable solvent for example water; alcohol (for example, methanol, ethanol, propanol); acetone; methylcellosolve; or a mixture of such solvents.

Combinations of two or more of these dyes can also be used.

Actual examples of such dyes have been disclosed in JP-A-63-64039.

Ultraviolet absorbing dyes have also been disclosed, for example in U.S. Pat. Nos. 3,533,794, 3,314,794 and 3,352,681; JP-A-46-2784; U.S. Pat. Nos. 3,705,805, 3,707,375, 4,045,229, 3,700,455, 3,499,762; and West German Patent Application (DAS)1,547,863.

Moreover, use can also be made of the pyrazolone oxonol dyes disclosed in U.S. Pat. No. 2,274,782; the diarylazo dyes disclosed in U.S. Pat. No. 2,956,879; the styryl dyes and butadienyl dyes disclosed in U.S. Pat. Nos. 3,423,207 and 3,384,487; the merocyanine dyes disclosed, for example, in U.S. Pat. No. 2,527,583; the merocyanine dyes and oxonol dyes disclosed in U.S. Pat. Nos. 3,486,897, 3,652,284 and 3,718,472; the enamino hemioxonol dyes disclosed in U.S. Pat. No. 3,976,661; the dyes disclosed in British Patents 584,609 and 1,177,429; JP-A-48-85130; JP-A-49-99620; JP-A-49-114420; and U.S. Pat. Nos. 2,533,473, 3,148,187, 3,177,078, 3,247,127, 3,540,887, 3,575,704 and 3,653,905.

Inorganic and organic film hardening agents can be included in the photographic emulsion layers and other hydrophilic colloid layers in the photographic materials of this invention. For example, use can be made of chromium salts (for example, chromium alum and chromium acetate); aldehydes (for example, formaldehyde, glyoxal and glutaraldehyde); N-methylol compounds (for example, dimethylolurea and methyloldimethylhydantoin); dioxane derivatives (for example, 2,3-dihydroxydioxane); active vinyl compounds (for example, 1,3,5-triacryloyl-hexahydro-s-triazine and 1,3-vinylsulfonyl-2-propanol); active halogen compounds (for example, 2,4-dichloro-6-hydroxy-s-triazine); mucohalogenic acids (for example, mucochrolic acid and mucophenoxychloric acid); epoxy compounds (for example, tetramethyleneglycol diglicidyl ether); and isocyanate compounds (for example, hexamethylene diisocyanate), either individually or in combinations.

Furthermore, the polymeric film hardening agents disclosed in JP-A-56-66841, British Patent 1,322,971, and U.S. Pat. No. 3,671,256 can also be used.

Various surfactants can be included in the photographic emulsion layers and other structural layers of the photosensitive materials prepared using this invention for various purposes, for example as coating promotors, as anti-static agents, for improving slip properties, for emulsification and dispersion purposes, to prevent the occurrence of sticking and for improving photographic characteristics (for example, for accelerating development, increasing contrast, and increasing speed).

For example, use can be made of non-ionic surfactants (such as saponin (steroid based); alkyleneoxide derivatives (for example, polyethyleneglycol, polyethylene glycol/polypropylene glycol condensates, polyethylene glycol alkyl ethers or polyethylene glycol alkyl aryl ethers, polyethylene glycol esters, polyethylene glycol sorbitane esters, polyalkylene glycol alkylamines or amides, and polyethylene oxide adducts of silicones); glycidol derivatives (for example, alkenylsuccinic acid polyglyceride and alkylphenol polyglyceride); fatty acid esters of polyhydric alcohols; and sugar alkyl esters); anionic surfactants (which contain acid groups, such as carboxyl groups, sulfo groups, phospho groups, sulfate ester groups, phosphate ester groups etc., for example, alkylcarboxylates, alkylsulfonates, alkylbenzenesulfonates, alkylnaphthalenesulfonates, alkyl sulfate esters, alkyl phosphate esters, N-acyl-N-alkyltaurines, sulfosuccinic acid esters, sulfoalkylpolyoxyethylenealkylphenyl ethers, and polyoxyethylenealkyl phosphate esters); amphoteric surfactants (such as amino acids, aminoalkylsulfonic acids, aminoalkyl sulfate or phosphate esters, alkylbetaines and amine oxides; and cationic surfactants, (such as alkylamine salts, aliphatic or aromatic quaternary ammonium salts, heterocyclic quaternary ammonium salts such as pyridinium salts and imidazolium salts, and sulfonium or phosphonium salts which contain an aliphatic or heterocyclic ring)).

The preferred surfactants for use in this invention are the poly(alkylene oxides) of molecular weight at least 600 disclosed in JP-B-58-9412. Polymer latexes such as poly(alkyl acrylate) latex can also be included to provide dimensional stability.

Photographic characteristics with ultra-high contrast can be obtained with silver halide photosensitive materials of this invention using stable development baths. The use of conventional infectious development baths or highly alkaline development baths of pH approaching 13 a disclosed in U.S. Pat. No. 2,419,975 is unnecessary.

That is to say, the silver halide photosensitive materials of this invention can be processed in development baths which contain at least 0.15 mol/liter of sulfite ion as a preservative and of which the pH is between 9.5 and 12.3, and preferably between 10.0 and 12.0, to provide satisfactorily ultra-high contrast negative images.

No particular limitation is imposed upon the developing agents which can be used to develop the material of this invention. Use can be made, for example, of dihydroxybenzenes (such as hydroquinone); 3-pyrazolidones (such as 1-phenyl-3-pyrazolidone and 4,4-dimethyl-1-phenyl-3-pyrazolidone); and aminophenols (such as N-methyl-p-aminophenol) either individually or in combinations.

Processing in development baths which contain dihydroxybenzenes as the principal developing agent and 3-pyrazolidones or aminophenols as auxiliary developing agents is especially suitable for the silver halide photosensitive materials of this invention. Development baths in which dihydroxybenzenes at a concentration of from 0.05 to 0.5 mol/liter are used conjointly with 3-pyrazolidones or aminophenols at a concentration of not more than 0.06 mol/liter are preferred.

The rate of development can be increased and the development time can be shortened by adding amines to the development bath, as disclosed in U.S. Pat. No. 4,269,929.

Furthermore, pH buffers such as alkali metal sulfites, carbonates, borates and phosphates, and development inhibitors of anti-foggants, such as bromides, iodides and organic anti-foggants (among which the nitroindazoles or benzotriazoles are especially desirable) can also be included in the development bath. Furthermore, water softening agents, dissolution promotors, color toning agents, development accelerators, surfactants (along which the poly(alkylene oxides) described earlier are especially desirable), antifoaming agents, film hardening agents, and agents for preventing silver contamination of the films (for example, 2-mercaptobenzimidazolesulfonic acids) can also be included, as required.

The fixing agent compositions generally used can be used as fixing baths. The organic sulfur compounds known to be effective as fixing agents can be used as well as thiosulfates and thiocyanates as the fixing agent. Film hardening agents, for example, water soluble aluminum salts can also be used in the fixer bath.

A processing temperature between 18° C. and 50° C. is normally selected for developing the material of this invention.

Photographic processing is preferably carried out using an automatic processor, and even if the total processing time from entry of the photosensitive material into the automatic processor to its emergence from the processor is set between 90 seconds and 120 seconds it is still possible to obtain satisfactory photographic characteristics of ultra-high contrast negative gradation by means of the invention.

The compounds disclosed in JP-A-56-24347 can be used as agents for preventing silver staining in the development baths of this invention. The compounds disclosed in JP-A-61-267759 can be used as the dissolution promotors which are added to development baths. Moreover, the compounds disclosed in JP-A-60-93433 or the compounds disclosed in JP-A-62-186259 can be used as the pH buffers which are used in the development baths.

The invention is described in detail by means of illustrative examples below. The formula of the development bath used in these examples was as indicated below.

| Development Bath | |
|---|---|
| Hydroquinone | 45.0 grams |
| N-methyl-p-aminophenol hemi-sulfate | 0.8 gram |
| Sodium hydroxide | 18.0 grams |
| Potassium hydroxide | 55.0 grams |
| 5-Sulfosalicylic acid | 45.0 grams |
| Boric acid | 25.0 grams |
| Potassium sulfite | 110.0 grams |
| Etylenediamine tetra-acetic acid, di-sodium salt | 1.0 gram |
| Potassium bromide | 6.0 grams |
| 5-Methylbenzotriazole | 0.6 gram |
| 2-Mercaptobenzimidazole-5-sulfonic acid | 0.3 grams |
| n-Butyldiethanolamine | 15.0 grams |
| Water | to make up to 1 liter (pH = 11.3) |

EXAMPLE 1

An aqueous solution of silver nitrate and an aqueous solution cf sodium chloride were mixed simultaneously in the presence of $5.0\times10^{-6}$ mol per mol of silver of $(NH_4)_3RhCl_6$ with an aqueous which was being maintained at 40° C., after which the soluble salts were removed using a method well known in the industry. Gelatin was then added and 2-methyl-4-hydroxy-1,3,3a,7-tetraazaindene was added as a stabilizer without chemical ripening. The emulsion so obtained was a mono-disperse emulsion of cubic crystalline form of which the average grain size was 0.12 μ.

After adding the compound of formula (I) and the compound of formula (IV) of this invention to the emulsion in the amounts shown in Table 1, a poly(ethyl acrylate) latex wa added at the rate (as solid fraction) of 30 wt % with respect to the gelatin and the resulting liquid was coated on a polyester support so as to provide a coated silver weight of 3.8 g/m². The coated weight of gelatin was 1.8 g/m².

A layer comprising 1.5 g/m² of gelatin and 0.3 g/m² of poly(methyl methacrylate) of particle size 1.5 μ was coated over this layer as a protective layer.

Furthermore, samples which did not contain a compound of formula (IV) were prepared as comparative examples. (Comparative samples 1-a to 1-g shown in Table 1)

Evaluation of Photographic Properties

The samples were exposed through an optical wedge using a P-607 room light printer made by the Dainippon Screen Co and developed for 30 seconds at 34° C., fixed, washed and dried.

The results obtained in respect of photographic properties are shown in Table 1.

The samples of this invention clearly gave higher contrast (gamma) than the comparative example samples.

Moreover, the speed in Table 1 is the logE value obtained on taking the speed for comparative example sample 1 as a standard. The gradation (gamma) value is the slope of the straight line joining the points of density 0.3 and 3.0 on the characteristic curve. The contrast increases as this value rises.

TABLE 1

| Sample No. | Compound of Formula (I) Type | Compound of Formula (I) Amount Added ($mg/m^2$) | Compound of Formula (IV) Type | Compound of Formula (IV) Amount Added ($mg/m^2$) | Speed (Relative Value) | Gradation (gamma) |
|---|---|---|---|---|---|---|
| 1-a | I-(1) | 3.0 | — | — | 0 | 4.5 |
| 1-b | I-(1) | 6.0 | — | — | +0.03 | 8.0 |
| 1-c | I-(1) | 12.0 | — | — | +0.07 | 17.1 |
| 1-d | I-(39) | 6.0 | — | — | 0 | 4.5 |
| 1-e | I-(39) | 18.0 | — | — | +0.04 | 8.7 |
| 1-f | I-(42) | 30.0 | — | — | +0.02 | 6.8 |
| 1-g | I-(42) | 75.0 | — | — | +0.03 | 8.3 |
| 1 | I-(1) | 6.0 | IV-(15) | 35 | +0.11 | 18.9 |
| 2 | I-(1) | 6.0 | IV-(15) | 70 | +0.25 | 23.4 |
| 3 | I-(39) | 18.0 | IV-(15) | 50 | +0.20 | 19.5 |
| 4 | I-(42) | 30.0 | IV-(15) | 50 | +0.10 | 18.7 |
| 5 | I-(1) | 6.0 | IV-(16) | 65 | +0.12 | 19.6 |
| 6 | I-(1) | 6.0 | IV-(57) | 15 | +0.22 | 20.2 |
| 7 | I-(39) | 18.0 | IV-(16) | 65 | +0.19 | 18.9 |
| 8 | I-(39) | 18.0 | IV-(57) | 15 | +0.20 | 19.3 |
| 9 | I-(42) | 30.0 | IV-(16) | 65 | +0.10 | 18.9 |
| 10 | I-(42) | 30.0 | IV-(47) | 15 | +0.12 | 19.1 |

EXAMPLE 2

Comparative Sample 1-c and Samples 1 and 2 of the invention in Example 1 were processed in the two tired development baths indicated below instead of in the development bath used in Example 1.

Tired Bath 1: A tired bath obtained by processing 200 sheets of photosensitive material measuring 50.8cm×61 cm in 20 liters of development bath in one day.

Tired Bath 2: Development bath in which no photosensitive material had been processed but which had deteriorated as a result of aerial oxidation.

The samples were exposed through a transparent original with a dot area of 50% on the optical wedge of Example 1 and the photographic speed (S) was obtained as the reciprocal of the exposure (E) required to obtain the ratio of black area to white area of 1:1. The difference in speed (ΔS) from that obtained with fresh developer was as shown in Table 2. It is clear that the changes in speed when the tired development baths were used were smaller with the samples of this invention, and that the processing stability was superior in this case.

TABLE 2

| Sample No. | ΔS Tired Bath 1 | ΔS Tired Bath 2 |
|---|---|---|
| 1-c | −0.21 | +0.35 |
| 1 | −0.07 | +0.05 |

TABLE 2-continued

| Sample No. | ΔS Tired Bath 1 | ΔS Tired Bath 2 |
|---|---|---|
| 2 | −0.04 | +0.07 |

While the invention has been described in detail and with reference to specific embodiments thereof, it will be apparent to one skilled in the art that various changes and modifications can be made therein without departing from the spirit and scope thereof.

What is claimed is:

1. An ultra-high contrast negative type silver halide photographic material comprising a support having thereon at least one silver halide emulsion layer and containing in said emulsion layer or another hydrophilic colloid layer formed on said support (i) at least one hydrazine derivative represented by formula (I)

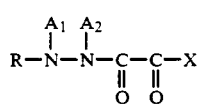

(I)

wherein $A_1$ and $A_2$ both represent hydrogen atoms, or one represents a hydrogen atom and the other represents a sulfinic acid residual group or an acyl group, R represents an aliphatic group, an aromatic group or a heterocyclic group, and X represents a group as indicated by formulae (II) and (III),

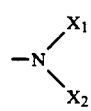

(II)

wherein $X_1$ and $X_2$ each represent a hydrogen atom, an alkyl group, an alkenyl group, an aryl group, and $X_1$ and $X_2$ may be joined together to form a ring, $$-O-X_3 \quad \text{(III)}$$

wherein $X_3$ represents a hydrogen atom, an alkyl group, an alkenyl group, an aryl group or a heterocyclic group; and (ii) at least one compound represented by formula (IV)

$$Y_0\text{-}[(A_0)_n\text{-}B]_m \quad \text{(IV)}$$

wherein $Y_0$ represents a group which promotes adsorption on silver halide which is selected from the group consisting of a nitrogen-containing heterocyclic group, a group with a thioamide linkage, a mercapto group, and a group with disulfide linkage, $A_0$ represents a divalent linking group comprising an atom or a group of atoms selected from carbon atoms, nitrogen atoms, oxygen atoms and sulfur atoms, a straight chain or branched alkylene group, a straight chain or branched alkenylene group, a straight chain or branched aralkylene group, a straight chain or branched alkynylene group, an arylene group,

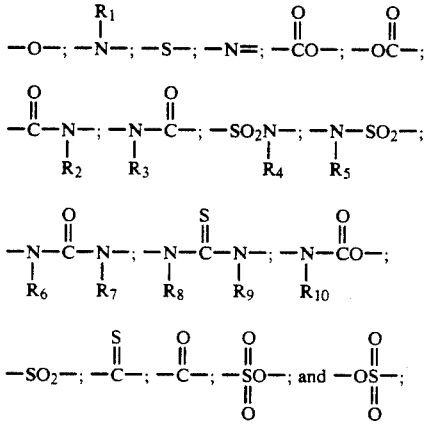

and groups that can be formed using any combination of these groups wherein $R_1$, $R_2$, $R_3$, $R_4$, $R_5$, $R_6$, $R_7$, $R_8$, $R_9$, and $R_{10}$ each represent a hydrogen atom, or substituted or unsubstituted alkyl group, a substituted or unsubstituted aryl group, a substituted or unsubstituted alkenyl group, or a substituted or unsubstituted aralkyl group, B represents an amino group, an ammonium group or a nitrogen-containing heterocyclic group, m represents 1, 2 or 3, and n represents 0 or 1.

2. The ultra-high contrast negative type silver halide photographic material as claimed in claim 1, wherein said amino groups represented by B in formula (IV) are represented by formula (VI)

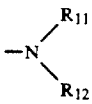

(VI)

wherein $R_{11}$ and $R_{12}$ each represents a hydrogen atom, a substituted or unsubstituted alkyl, alkenyl or aralkyl group having up to 30 carbon atoms, or an aryl group having up to 20 carbon atoms.

3. The ultra-high contrast negative type silver halide photographic material as claimed in claim 1, wherein said substituted or unsubstituted amino groups represented by B in formula (IV) are represented by formula (VII)

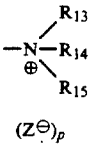

(VII)

where $R_{13}$, $R_{14}$ and $R_{15}$ each represents a hydrogen atom, a Substituted or unsubstituted alkyl, alkenyl or aralkyl group having up to 30 carbon atoms, or an aryl group having up to 20 carbon atoms; $Z^-$ represents an anion; and p represents 0, 1, 2, or 3.

4. The ultra-high contrast negative type silver halide photographic material as claimed in claim 1, wherein $A_1$ and $A_2$ represent hydrogen atoms, alkylsulfonyl or arylsulfonyl groups having no more than 20 carbon atoms, and acyl groups having no more than 20 carbon atoms; and R represents a straight chain, branched or cyclic alkyl, alkenyl, or alkynyl group.

5. The ultra-high contrast negative type silver halide photographic material as claimed in claim 1, wherein $A_1$ and $A_2$ represent hydrogen atoms; and R represents an aryl group.

6. The ultra-high contrast negative type silver halide photographic material as claimed in claim 1, wherein $A_1$ and $A_2$ represent phenylsulfonyl groups; substituted phenylsulfonyl groups of which the sum of the Hammett substituent constants is at least −0.5; benzoyl groups; substituted benzoyl groups of which the sum of the Hammett substituent constants is at least −0.5; or straight chain, branched or cyclic, substituted or unsubstituted aliphatic acyl groups.

7. The ultra-high contrast negative type silver halide photographic material as claimed in claim 1, wherein either R or X has a group which promotes adsorption on silver halide.

8. The ultra-high contrast negative type silver halide photographic material as claimed in claim 7, wherein said group hat promotes adsorption on silver halide is a mercapto group, a disulfide bond, or a 5- or 6-membered nitrogen-containing heterocyclic group.

9. The ultra-high contrast negative type silver halide photographic material as claimed in claim 7, wherein said group that promotes adsorption on silver halide is a heterocyclic mercapto group.

10. The ultra-high contrast negative type silver halide photographic material as claimed in claim 1, wherein the compound of formula (IV) is represented by formula (V)

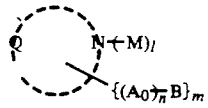

(V)

wherein l represents 0, or 1; Q represents a group of atoms required to form a 5- or 6-membered heterocyclic group comprising at least one atom selected from among carbon atoms, nitrogen atoms, oxygen atoms, sulfur atoms, selenium atoms, and tellurium atoms; M represents a hydrogen atom, an alkali metal atom, an alkaline earth metal atom, an ammonium group or a phosphonium group; and $-\{(A_0)_n\text{-}B\}_m$ has the same meaning as in formula (IV).

11. The ultra-high contrast negative type silver halide photographic material as claimed in claim 10, wherein said Q is a benzotriazole, a triazole, an azaindenes, or a triazine.

12. The ultra-high contrast negative type silver halide photographic material as claimed in claim 1, wherein the compound of formula (IV) is represented by formula (VIII) or formula (IX):

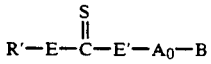

(VIII)

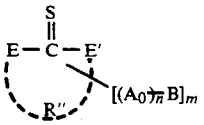

(IX)

wherein $A_0$, B, m, and n are the same as in claim 1; either E or E' each represents

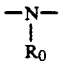

when the other represents —O—, —S— or

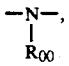

wherein $R_0$ and $R_{00}$ each represents a hydrogen atom, an aliphatic group, or an aromatic group; R' represents a hydrogen atom, an aliphatic group, or an aromatic group; and R'' represents a group of atoms necessary to form a 5- or 6-membered ring.

13. The ultra-high contrast negative type silver halide photographic material as claimed in claim 1, wherein said at least one hydrazine derivative of formula (I) and said at least one compound of formula (IV) are included in said at least one silver halide emulsion layer.

14. The ultra-high contrast negative type silver halide photographic material as claimed in claim 1, wherein said at least one hydrazine derivative of formula (I) is present in an amount of from $10^{-6}$ to $1\times10^{-1}$ mol per mol of silver halide, and said at least one compound of formula (IV) is present in an amount of from $1.0\times10^{-3}$ to 0.5 g/m$^2$.

15. The ultra-high contrast negative type silver halide photographic material as claimed in claim 1, wherein said at least one hydrazine derivative of formula (I) is present in an amount of from $1\times10^{-5}$ to $1\times10^{-2}$ mol per mol of silver halide, and said at least one compound of formula (IV) is present in an amount of from $5.0\times10^{-3}$ to 0.2 g/m$^2$.

16. The ultra-high contrast negative type silver halide photographic material as claimed in claim 1, wherein in the definition of $A_0$, the straight chain or branched alkylene group, the straight chain or branched alkenylene group, the straight chain or branched aralkylene group, the straight chain or branched alkynylene group, and the arylene group each have up to 12 carbon atoms.

17. The ultra-high contrast negative type silver halide photographic material as claimed in claim 1, wherein in the definition of $A_0$, the alkyl, aryl, alkenyl, and aralkyl groups representative of $R_1$, $R_2$, $R_3$, $R_4$, $R_5$, $R_6$, $R_7$, $R_8$, $R_9$, and $R_{10}$ have up to 12 carbon atoms.

* * * * *